US009114605B2

(12) United States Patent
Hiyoshi et al.

(10) Patent No.: US 9,114,605 B2
(45) Date of Patent: Aug. 25, 2015

(54) INK-JET HEAD DRIVE DEVICE

(71) Applicant: TOSHIBA TEC KABUSHIKI KAISHA, Shinagawa-ku, Tokyo (JP)

(72) Inventors: Teruyuki Hiyoshi, Shizuoka-ken (JP); Noboru Nitta, Shizuoka-ken (JP); Mamoru Kimura, Shizuoka-ken (JP); Shunichi Ono, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 125 days.

(21) Appl. No.: 13/973,112

(22) Filed: Aug. 22, 2013

(65) Prior Publication Data

US 2015/0054872 A1 Feb. 26, 2015

(51) Int. Cl.
*B41J 2/045* (2006.01)

(52) U.S. Cl.
CPC ..... *B41J 2/04541* (2013.01); *B41J 2/04588* (2013.01); *B41J 2/04581* (2013.01)

(58) Field of Classification Search
CPC ..... B41J 2/04541
See application file for complete search history.

(56) References Cited

U.S. PATENT DOCUMENTS

| | | | | |
|---|---|---|---|---|
| 6,437,964 | B1 | 8/2002 | Takamura et al. | |
| 7,850,264 | B2 * | 12/2010 | Kondoh | 347/9 |
| 8,926,042 | B2 * | 1/2015 | Ono et al. | 347/10 |
| 2002/0033644 | A1 | 3/2002 | Takamura et al. | |

* cited by examiner

*Primary Examiner* — Manish S Shah
*Assistant Examiner* — Jeffrey C Morgan
(74) *Attorney, Agent, or Firm* — Amin, Turocy & Watson, LLP

(57) ABSTRACT

A drive device includes a circuit for selecting an arbitrary voltage among a plurality of kinds of voltages required for generating a drive signal for variably controlling potential applied to electrodes of channels. In the drive device, respective drive voltage input terminals and output terminals are respectively connected by a low-impedance connecting circuit which has low internal resistance, and a selected voltage input terminal and the output terminals are connected by a high-impedance connecting circuit which has high internal resistance. The drive device controls a drive waveform transition pattern of a drive signal such that the drive signal is output via the high-impedance connecting circuit while the potential applied to the respective electrode simultaneously changes in the same direction out of a positive direction and a negative direction and that the drive signal is output via the low-impedance connecting circuit in the other cases.

6 Claims, 19 Drawing Sheets

FIG. 11

| STATE | TIM(usec) | | WV-A | | WV-B | |
|---|---|---|---|---|---|---|
| | | | HOME | HOME Hi-Z | NEIGH BOR | NEIGH BOR Hi-Z |
| STR0 | TIM0 | 0.10 | 3 | 0 | 3 | 0 |
| STR1 | TIM1 | 0.02 | 1 | 0 | 1 | 0 |
| STR2 | TIM2 | 0.30 | 0 | 0 | 1 | 0 |
| STR3 | TIM3 | 0.30 | 2 | 0 | 1 | 0 |
| STR4 | TIM4 | 0.30 | 2 | 0 | 1 | 0 |
| STR5 | TIM5 | 0.90 | 2 | 0 | 1 | 0 |
| STR6 | TIM6 | 0.30 | 2 | 0 | 1 | 0 |
| STR7 | TIM7 | 0.10 | 2 | 0 | 1 | 0 |
| STR8 | TIM8 | 0.12 | 0 | 0 | 1 | 0 |
| STR9 | TIM9 | 0.48 | 1 | 0 | 1 | 0 |
| STR10 | TIM10 | 1.10 | 3 | 0 | 3 | 0 |
| STR11 | TIM11 | 0.50 | 0 | 0 | 0 | 0 |
| STR12 | TIM12 | 0.10 | 0 | 0 | 2 | 0 |
| STR13 | TIM13 | 0.20 | 0 | 0 | 2 | 0 |
| STR14 | TIM14 | 1.30 | 1 | 0 | 2 | 0 |
| STR15 | TIM15 | 0.10 | 1 | 0 | 2 | 0 |
| STR16 | TIM16 | 0.20 | 1 | 0 | 2 | 0 |
| STR17 | TIM17 | 0.10 | 1 | 0 | 2 | 0 |
| STR18 | TIM18 | 0.20 | 1 | 0 | 2 | 0 |
| STR19 | TIM19 | 0.30 | 1 | 0 | 0 | 0 |
| STR20 | TIM20 | 0.30 | 0 | 0 | 0 | 0 |
| STR21 | TIM21 | 0.02 | 0 | 0 | 0 | 0 |
| STR22 | TIM22 | 0.02 | 0 | 0 | 0 | 0 |
| STR23 | TIM23 | 0.02 | 0 | 0 | 0 | 0 |
| STR24 | TIM24 | 0.02 | 0 | 0 | 0 | 0 |
| STR25 | TIM25 | 0.02 | 0 | 0 | 0 | 0 |
| STR26 | TIM26 | 0.02 | 0 | 0 | 0 | 0 |
| STR27 | TIM27 | 0.02 | 0 | 0 | 0 | 0 |
| STR28 | TIM28 | 0.02 | 0 | 0 | 0 | 0 |
| STR29 | TIM29 | 0.02 | 0 | 0 | 0 | 0 |
| STR30 | TIM30 | 0.02 | 0 | 0 | 0 | 0 |
| STR31 | TIM31 | 0.02 | 0 | 0 | 0 | 0 |

FIG. 12

| LVSTR | LVTIM(usec) | | LV_CD |
|---|---|---|---|
| LVSTR0 | LVTIM0 | 0.32 | 1 |
| LVSTR1 | LVTIM1 | 2.90 | 0 |
| LVSTR2 | LVTIM2 | 5.12 | 1 |
| LVSTR3 | LVTIM3 | 5.12 | 1 |
| LVSTR4 | LVTIM4 | 5.12 | 1 |
| LVSTR5 | LVTIM5 | 5.12 | 1 |
| LVSTR6 | LVTIM6 | 5.12 | 1 |
| LVSTR7 | LVTIM7 | 5.12 | 1 |

FIG. 14

| STATE | TIM(usec) | | WV-A | | WV-B | |
|---|---|---|---|---|---|---|
| | | | HOME | HOME Hi-Z | NEIGH BOR | NEIGH BOR Hi-Z |
| STR0 | TIM0 | 0.10 | 3 | 0 | 3 | 1 |
| STR1 | TIM1 | 0.02 | 2 | 0 | 2 | 0 |
| STR2 | TIM2 | 1.32 | 2 | 0 | 2 | 0 |
| STR3 | TIM3 | 0.10 | 2 | 0 | 2 | 0 |
| STR4 | TIM4 | 0.20 | 0 | 0 | 2 | 0 |
| STR5 | TIM5 | 0.10 | 1 | 0 | 2 | 0 |
| STR6 | TIM6 | 0.20 | 1 | 0 | 2 | 0 |
| STR7 | TIM7 | 0.30 | 1 | 0 | 0 | 0 |
| STR8 | TIM8 | 0.30 | 0 | 0 | 0 | 0 |
| STR9 | TIM9 | 0.02 | 0 | 0 | 0 | 0 |
| STR10 | TIM10 | 1.10 | 3 | 0 | 3 | 0 |
| STR11 | TIM11 | 0.02 | 1 | 0 | 1 | 0 |
| STR12 | TIM12 | 0.30 | 0 | 0 | 1 | 0 |
| STR13 | TIM13 | 0.30 | 2 | 0 | 1 | 0 |
| STR14 | TIM14 | 1.30 | 2 | 0 | 1 | 0 |
| STR15 | TIM15 | 0.90 | 2 | 0 | 1 | 0 |
| STR16 | TIM16 | 0.30 | 2 | 0 | 1 | 0 |
| STR17 | TIM17 | 0.10 | 2 | 0 | 1 | 0 |
| STR18 | TIM18 | 0.12 | 0 | 0 | 1 | 0 |
| STR19 | TIM19 | 0.48 | 1 | 0 | 1 | 0 |
| STR20 | TIM20 | 0.10 | 3 | 0 | 3 | 0 |
| STR21 | TIM21 | 1.50 | 0 | 0 | 0 | 0 |
| STR22 | TIM22 | 0.10 | 0 | 0 | 2 | 0 |
| STR23 | TIM23 | 0.02 | 0 | 0 | 2 | 0 |
| STR24 | TIM24 | 1.30 | 1 | 0 | 2 | 0 |
| STR25 | TIM25 | 0.10 | 1 | 0 | 2 | 0 |
| STR26 | TIM26 | 0.20 | 1 | 0 | 2 | 0 |
| STR27 | TIM27 | 0.10 | 1 | 0 | 2 | 0 |
| STR28 | TIM28 | 0.20 | 1 | 0 | 2 | 0 |
| STR29 | TIM29 | 0.30 | 1 | 0 | 0 | 0 |
| STR30 | TIM30 | 0.30 | 0 | 0 | 0 | 0 |
| STR31 | TIM31 | 0.02 | 0 | 0 | 0 | 0 |

FIG. 15

| LVSTR | LVTIM(usec) | | LV_CD |
|---|---|---|---|
| LVSTR0 | LVTIM0 | 0.32 | 2 |
| LVSTR1 | LVTIM1 | 0.30 | 0 |
| LVSTR2 | LVTIM2 | 2.54 | 1 |
| LVSTR3 | LVTIM3 | 2.92 | 0 |
| LVSTR4 | LVTIM4 | 5.12 | 2 |
| LVSTR5 | LVTIM5 | 5.12 | 2 |
| LVSTR6 | LVTIM6 | 5.12 | 2 |
| LVSTR7 | LVTIM7 | 5.12 | 2 |

INK-JET HEAD DRIVE DEVICE

FIELD

Embodiments described herein relate generally to an ink-jet head drive device used in an ink-jet recording apparatus or the like.

BACKGROUND

Generally, an ink-jet head includes a plurality of nozzles, a plurality of ink chambers which are provided so as to respectively communicate with the respective nozzles, and a plurality of actuators which individually change volumes of the respective ink chambers. An ink flow path which includes a nozzle and an ink chamber communicating with the nozzle is referred to as a channel. Piezoelectric members are used as the actuators. An electrode is attached to each piezoelectric member, and drive voltage with predetermined drive waveforms is applied to electrodes at both ends of the piezoelectric member arranged between a channel as a target of ink ejection and a channel adjacent to the channel. If the drive voltage is respectively applied to the electrodes at both ends, the piezoelectric member performs a deforming operation in accordance with a potential difference between the electrodes at both ends. The volume of the ink chamber in the channel as a target of ink ejection varies due to the deforming operation, and ink in the ink chamber is ejected from the nozzle due to the variation in the volume.

Incidentally, there is a case where potential applied to the electrodes at both the ends of the piezoelectric member simultaneously changes in a same direction out of a positive direction and a negative direction, depending on an application pattern of the drive voltage. At this time, the piezoelectric member does not act as load capacity and is brought to be in an unloaded state. If the piezoelectric member is in the unloaded state, voltage applied to the electrodes of the piezoelectric member steeply changes. Such a steep change in the voltage causes a noise and becomes a cause for erroneous operation.

In the related art, a technique for suppressing a steep change in voltage applied to electrodes of a piezoelectric member by controlling the voltage applied to the electrodes of the high-impedance piezoelectric member while the potential applied to the electrodes at both ends of the piezoelectric member simultaneously changes in the same direction out of a positive direction and a negative direction is known as a technique for reducing such noise.

According to such a technique in the related art, however, it is necessary to prepare, for each channel drive circuit, a detection circuit for detecting that the potential applied to the electrodes at both the ends of the piezoelectric member simultaneously changes in the same direction out of the positive direction and the negative direction. Therefore, since many detection circuits are required in a case of an ink-jet head of multiple channels, there is a concern that an Integrated Circuit (IC) increases in size, which results in an increase in cost, in consideration of configuring the IC of a drive device in which respective channel drive circuits are integrated.

DESCRIPTION OF THE DRAWINGS

FIG. 11 is a diagram showing a first pattern example of a drive waveform code group generated by a drive waveform code generation circuit and a drive waveform high-impedance signal group.

FIG. 12 is a diagram showing a pattern example of a load voltage control code generated by a load voltage control code generation circuit in the first pattern example.

FIG. 14 is a diagram showing a second pattern example of the drive waveform code group generated by the drive waveform code generation circuit and the drive waveform high-impedance signal group.

FIG. 15 is a diagram showing a pattern example of the load voltage control code generated by the load voltage control code generation circuit in the second pattern example.

DETAILED DESCRIPTION

According to one embodiment, an ink-jet head drive device includes a voltage selecting means, a plurality of channel drive means, and a drive waveform transition control means. The voltage selecting means selects an arbitrary voltage among a plurality of kinds of voltages required for generating a drive signal for variably controlling potential applied to electrodes which are respectively arranged in a plurality of channels of an ink-jet head. The plurality of channel drive means are provided corresponding to the respective channels of the ink-jet head. Each of the plurality of channel drive means includes an output terminal provided corresponding to each channel of the ink-jet head so as to output the drive signal to a corresponding channel, a plurality of drive voltage input terminals, to which the plurality of kinds of voltage is respectively applied, and a selected voltage input terminal, to which the voltage selected by the voltage selecting means is applied. Each of the plurality of channel drive means connects the drive voltage input terminal with the output terminal by a low-impedance connecting circuit which has low internal resistance and connects the selected voltage input terminal with the output terminal by a high-impedance connecting circuit which has high internal resistance. The drive waveform transition control means controls a drive waveform transition pattern of the drive signal for each channel drive means such that the drive signal is output via the high-impedance connecting circuit while potential applied to the respective electrodes simultaneously changes in a same direction out of a positive direction and a negative direction and that the drive signal is output via the low-impedance connecting circuit in the other cases.

First, a description will be given of an ink-jet head 1 used in an embodiment with reference to FIGS. 17 to 21.

Figure 17:
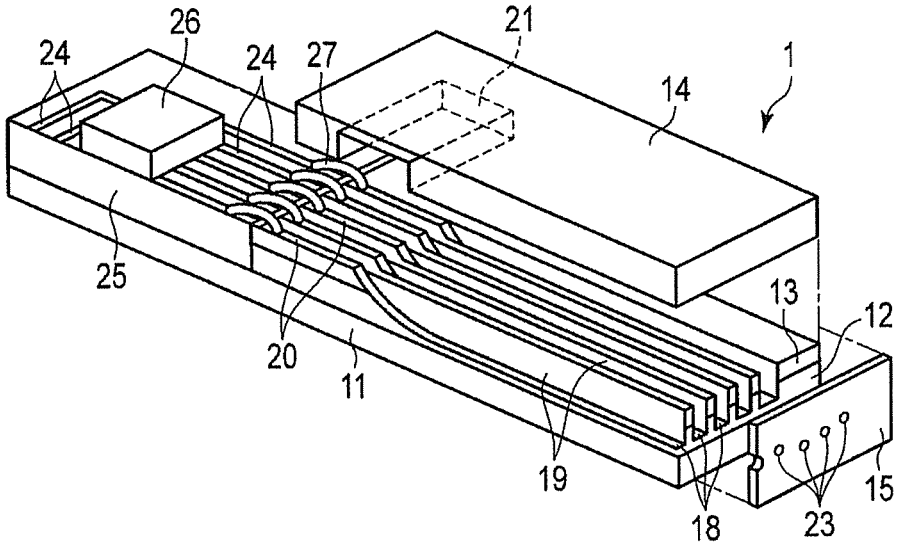
FIG. 17 is a perspective view showing a part of an ink-jet head in an exploded manner.
Figure 18:
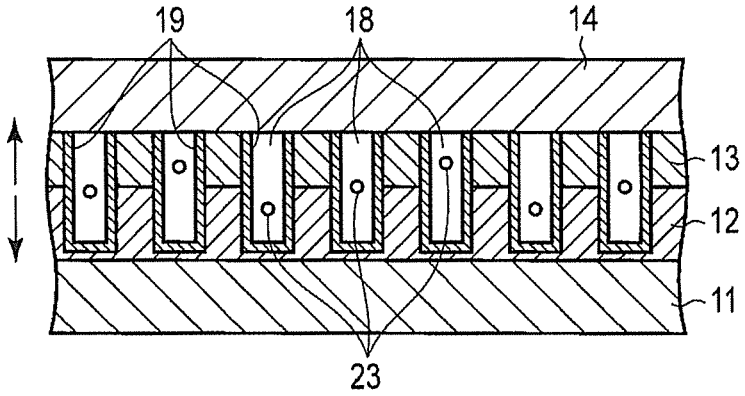
FIG. 18 is a horizontal cross-sectional view of a front portion of the ink-jet head.
Figure 19:
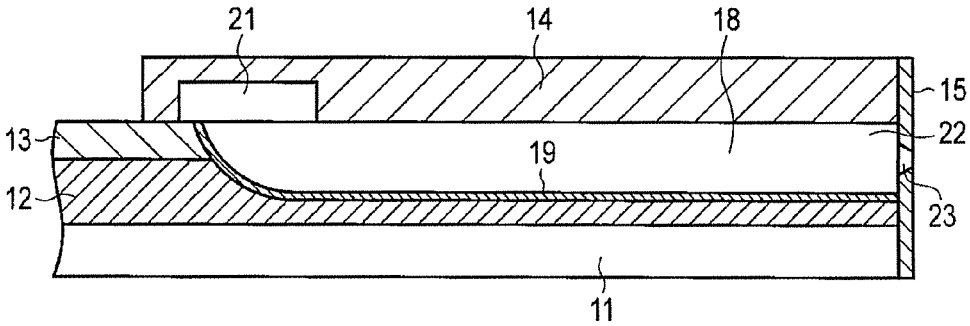
FIG. 19 is a vertical cross-sectional view of the front portion.

FIGS. 17 to 19 are structure diagrams of main components of the ink-jet head 1. FIG. 17 is a perspective view showing a part of the ink-jet head 1 in an exploded manner, FIG. 18 is a horizontal cross-sectional view of a front portion of the ink-jet head 1, and FIG. 19 is a vertical cross-sectional view of the front portion of the head 1.

In the ink-jet head 1, a first piezoelectric member 12 is bonded to an upper surface of a base substrate 11 in the front side, and a second piezoelectric member 13 is boned to the upper side of the first piezoelectric member 12. The first piezoelectric member 12 and the second piezoelectric member 13 are bonded so as to be polarized in opposite directions along a plate thickness direction as shown by the arrows in FIG. 18.

The ink-jet head 1 is provided with multiple long grooves 18 from a front end side of the bonded piezoelectric members 12 and 13 to a back end side thereof. The respective grooves 18 are arranged at constant intervals in parallel with each other. In addition, front ends of the respective grooves 18 open, and back ends thereof are inclined upward.

The ink-jet head 1 includes electrodes 19 provided at partition walls and bottom surfaces of the respective grooves 18. Furthermore, the ink-jet head 1 includes lead-out electrodes 20 extended from the electrodes 19 from the back ends of the respective grooves 18 toward the back upper surface of the second piezoelectric member 13.

In the ink-jet head 1, an upper portion of the respective grooves 18 is blocked by a top board 14, and front ends of the respective grooves 18 are blocked by an orifice plate 15. The top board 14 includes a common ink chamber 21 provided at an inner back side.

In the ink-jet head 1, the respective grooves 18 surrounded by the top board 14 and the orifice plate 15 form a plurality of ink chambers 22. In the ink-jet head 1, nozzles 23 for ejecting ink open at positions in the orifice plate 15, at which the nozzles 23 face the respective grooves 18. The nozzles 23 communicate with facing ink chambers 22. Here, ink flow paths which include the nozzles 23 and the ink chambers 22 communicating with the nozzles 23 are referred to as channels.

In the ink-jet head 1, a print substrate 25 with a conductive pattern 24 formed thereon is bonded to the upper surface of the base substrate 11 on the back side, and a drive IC 26, on which an ink-jet head drive device 30 (see FIG. 1) as will be described later is mounted, is equipped on the print substrate 25. The drive IC 26 is connected to the conductive pattern 24. The conductive pattern 24 is coupled to the respective lead-out electrodes 20 via lead wires 27 by wire bonding.

Figure 20A:
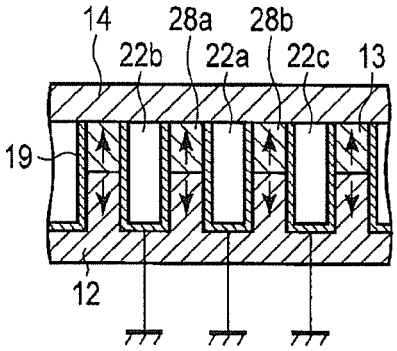
FIGS. 20A to 20C are diagrams illustrating operation principles.
Figure 20B:
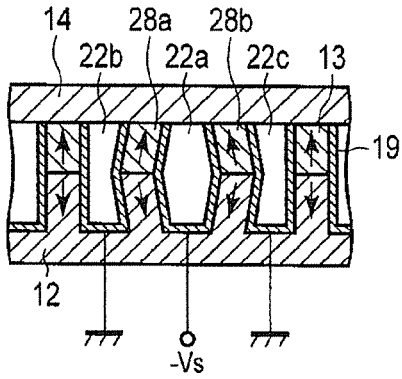
Figure 20C:
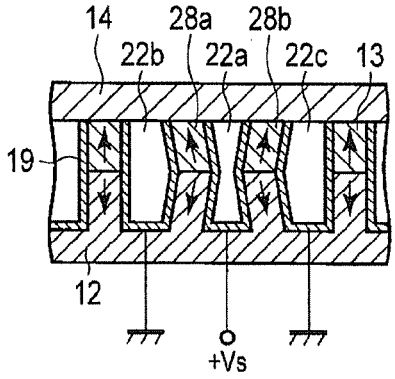

FIGS. 20A to 20C are diagrams for illustrating operation principles of the ink-jet head 1.

FIG. 20A shows a state where all the respective electrodes 19 of an ink chamber 22*a* at the center and ink chambers 22*b* and 22*c* on both sides which are adjacent to the ink chamber 22*a* are at ground potential. In this state, partition walls (actuators) 28*a* and 28*b* configured by the piezoelectric members 12 and 13 which are interposed between the ink chamber 22*a* and the ink chamber 22*b* and between the ink chamber 22*a* and the ink chamber 22*c* are not affected at all by a distortion action.

FIG. 20B shows a state where negative voltage (−Vs) is applied to the electrode 19 of the ink chamber 22*a* at the center. In addition, both the electrodes 19 of the ink chambers 22*b* and 22*c* on both sides thereof are at ground potential. In this state, an electric field acts on the respective partition walls 28*a* and 28*b* in a direction orthogonal to a polarization direction of the piezoelectric members 12 and 13. By this action, the respective partition walls 28*a* and 28*b* respectively deform outward so as to expand the volume of the ink chamber 22*a*.

FIG. 20C shows a state where positive voltage (+Vs) is applied to the electrode 19 of the ink chamber 22*a* at the center. In addition, both the electrodes 19 of the ink chambers 22*b* and 22*c* on both sides thereof are at ground potential. In this state, an electric field acts on the respective partition walls 28*a* and 28*b* in a direction orthogonal to a polarization direction of the piezoelectric members 12 and 13, namely an opposite direction to the direction shown in FIG. 20B. By this action, the respective partition walls 28*a* and 28*b* respectively deform inward so as to contract the volume of the ink chamber 22*a*.

Figure 21:
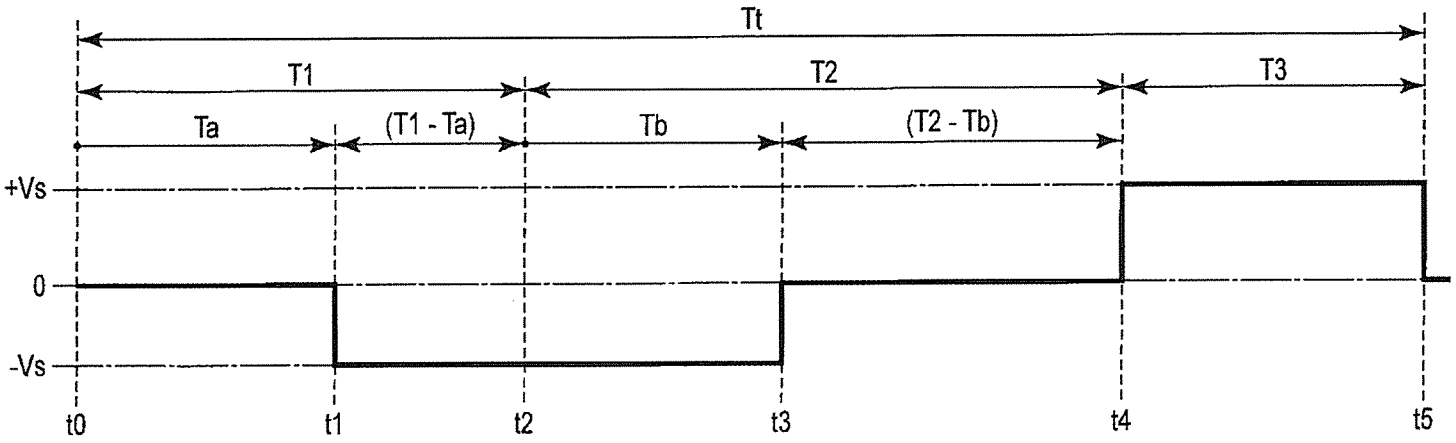
FIG. 21 is an energization waveform diagram of a drive pulse signal applied to the ink-jet head.

FIG. 21 is an energization waveform diagram of a drive pulse signal DP applied to the electrode 19 of the ink chamber 22*a* in order to eject ink droplets from the ink chamber 22*a* at the center. A section represented as time Tt is time necessary for ejecting an ink droplet (1 drop), and the time (referred to as a one-drop cycle Tt) is divided into time T1 as a preparation section, time T2 as an ejecting section, and time T3 as a post-processing section. Furthermore, the preparation time T1 is sub-divided into time Ta as a stationary section and time (T1-Ta) as an expanding section, and the time T2 as the ejecting section is sub-divided into time Tb as a maintaining section and time (T2-Tb) as a recovering section. The preparation time T1, the ejecting time T2, and the post-processing time T3 are set to appropriate values depending on conditions such as ink to be used and temperature.

First, the ink-jet head drive device 30 applies O-volt reference voltage to the respective electrodes 19 corresponding to the ink chambers 22*a*, 22*b*, and 22*c* at a timing t0 as shown in FIG. 21. Then, the ink-jet head drive device 30 waits until the stationary time Ta passes. During this time, the respective ink chambers 22*a*, 22*b*, and 22*c* are brought into a state shown in FIG. 20A.

At the timing t1 after the elapse of the stationary time Ta, the ink-jet head drive device 30 applies predetermined negative voltage (−Vs) as drive voltage to the electrode 19 corresponding to the ink chamber 22*a*. Then, the ink-jet head drive device 30 waits until the preparation time T1 passes. If the negative voltage (−Vs) is applied, the partition walls 28*a* and 28*b* on both sides of the ink chamber 22*a* deform outward so as to expand the volume of the ink chamber 22*a* and are brought into a state shown in FIG. 20B. By such deformation, pressure in the ink chamber 22*a* is reduced. Therefore, the ink flows into the ink chamber 22*a* from the common ink chamber 21.

At a timing t2 after the elapse of the preparation time T1, the ink-jet head drive device 30 continuously applies the negative voltage (−Vs) to the electrode 19 corresponding to the ink chamber 22*a* until the maintaining time Tb further passes. During this time, the respective ink chambers 22*a*, 22*b*, and 22*c* are maintained in the state shown in FIG. 20B.

At a timing t3 after the elapse of the maintaining time Tb, the ink-jet head drive device 30 returns the voltage applied to the electrode 19 corresponding to the ink chamber 22*a* to the 0-volt reference voltage. Then, the ink-jet head drive device 30 waits until the ejecting time T2 passes. If the applied voltage reaches 0 volts, the partition walls 28*a* and 28*b* on both sides of the ink chamber 22*a* are recovered to the stationary state and returned to the state shown in FIG. 20A. By such recovery, the pressure in the ink chamber 22*a* increases. For this reason, an ink droplet is ejected from the nozzle 23 corresponding to the ink chamber 22*a*.

At a timing t4 after the elapse of the ejecting time T2, the ink-jet head drive device 30 applies the predetermined positive voltage (+Vs) as drive voltage to the electrode 19 corresponding to the ink chamber 22*a*. Then, the ink-jet head drive device 30 waits until the post-processing time T3 passes. If the positive voltage (+Vs) is applied, the partition walls 28*a* and 28*b* on both sides of the ink chamber 22*a* respectively deform inward so as to contract the volume of the ink chamber 22*a* and are brought into a state shown in FIG. 20C. By such deformation, the pressure in the ink chamber 22*a* further increases. Therefore, a steep decrease in pressure which occurs in the ink chamber 22*a* due to the ejection of the ink droplet is attenuated.

At a timing t5 after the elapse of the post-processing T3, the ink-jet head drive device 30 returns again the voltage applied to the electrode 19 corresponding to the ink chamber 22*a* to the 0-volt reference voltage. In response to the applied voltage returned to 0 volts, the partition walls 28*a* and 28*b* on both sides of the ink chamber 22*a* are recovered to the stationary state. That is, the respective ink chambers 22*a*, 22*b*, and 22*c* are returned to the state shown in FIG. 20A.

The ink-jet head drive device 30 supplies the drive pulse signal DP with an energization waveform as shown in FIGS. 20A to 20C to the electrode 19 of the ink chamber 22*a* at the center. In doing so, an ink droplet corresponding to one drop is ejected from the nozzle 23 corresponding to the ink chamber 22*a*.

Next, a description will be given of an embodiment of the ink-jet head drive device 30 with reference to FIGS. 1 to 16. In this embodiment, the ink-jet head drive device 30 compatible with three types of drive power sources, namely a VAP power source, a VAN power source, and GND will be exemplified as a drive device for the ink-jet head 1 with N channels (ch.1 to ch.N; however, N>1 is satisfied).

Figure 1:
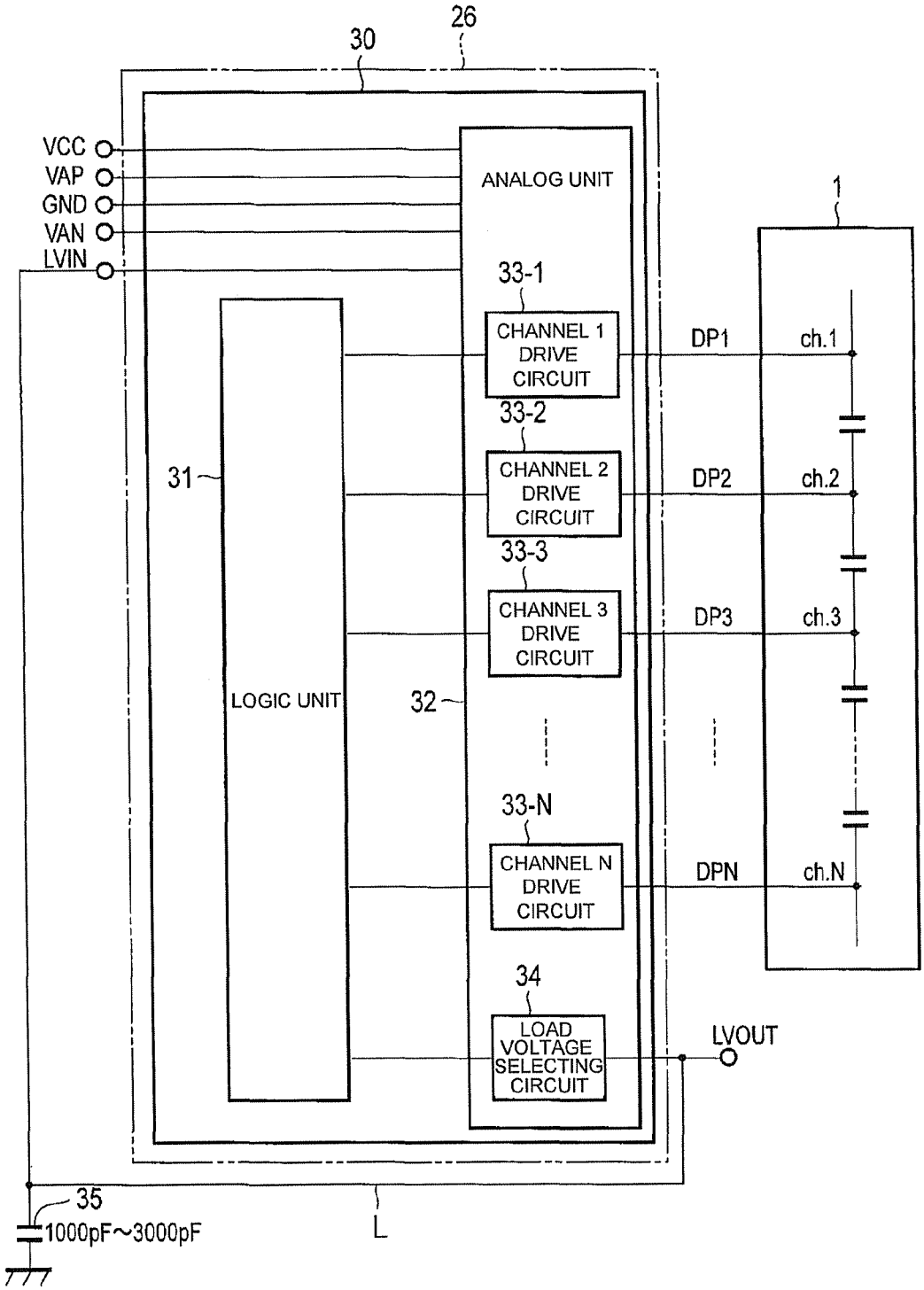
FIG. 1 is an outlined configuration diagram of an ink-jet head drive device according to an embodiment.

FIG. 1 is an outlined configuration diagram of the ink-jet head drive device 30. The ink-jet head drive device 30 which is mounted on the drive IC 26 includes a logic unit 31 and an analog unit 32.

The analog unit 32 includes N channel drive circuits 33-1 to 33-N as a channel drive portion provided corresponding to the respective channels ch.1 to ch.N of the ink-jet head 1, respectively, and a load voltage selecting circuit 34 as a voltage selecting portion. In addition, a VCC terminal, a VAP terminal, a VAN, a GND terminal, and an LVIN terminal as power terminals are connected to the analog unit 32.

A power source to supply VCC voltage, namely a so-called VCC power source is connected as a power source of channel drive circuits 33-1 to 33-N and the load voltage selecting circuit 34 to the VCC terminal. The GND terminal is grounded to a GND (ground) level. A power source to supply VAP voltage, namely a so-called VAP power source is connected as a power source to generate drive pulse signals DP1 to DPN to the VAP terminal. A power source to supply VAN voltage, a so-called VAN power source is connected as a power source to similarly generate the drive pulse signals DP1 to DPN to the VAN terminal. Here, the VAP voltage is positive drive voltage with potential in a positive direction as compared with the GND level as the reference voltage. The VAN voltage is negative drive voltage with potential which is the same as that of the positive drive voltage in the negative direction as compared with the GND level.

The respective channel drive circuits 33-1 to 33-N generate the drive pulse signals DP1 to DPN for each channel depending on the VAP voltage and the VAN voltage as drive voltage and the GND level as the reference voltage. The respective drive pulse signals DP1 to DPN are output to the electrodes 19 of the ink chambers 22 which respectively configure the corresponding channels ch.1 to ch.N.

The load voltage selecting circuit 34 selects an arbitrary load voltage LV among the VAP voltage, the VAN voltage, and the GND level. The load voltage LV selected by the load voltage selecting circuit 34 is supplied to an LVIN terminal. To a power source line L which connects between a load voltage output terminal LVOUT and the LVIN terminal of the load voltage selecting circuit 34, a capacitor 35 of 1000 pF to 3000 pF is coupled as a capacitor for stabilizing output potential. The capacitor 35 is inserted between the power source line L and the GND level.

Figure 2:
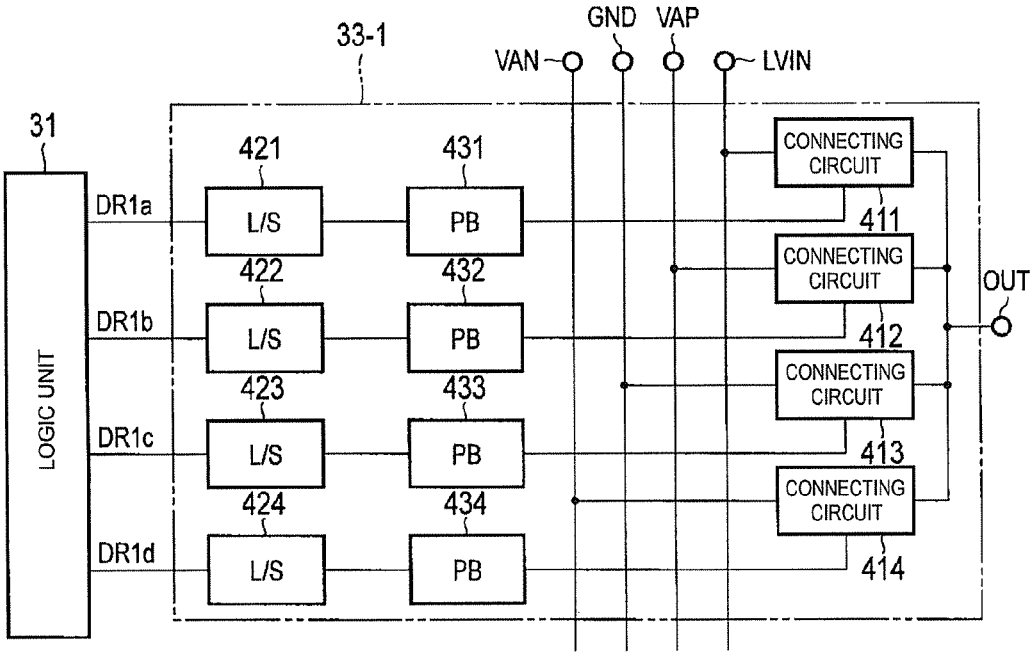
FIG. 2 is a configuration diagram of a channel drive circuit included in the ink-jet head drive device.

FIG. 2 is a configuration diagram of the channel drive circuit 33-1. In addition, since the other channel drive circuits 33-2 to 33-N have the same configuration as that of the channel drive circuit 33-1, descriptions thereof will be omitted.

The channel drive circuit 33-1 includes a VAP terminal, a VAN terminal, and a GND terminal as drive voltage input terminals, an LVIN terminal as a selected voltage input terminal, and an OUT terminal as an output terminal. The electrode 19 of the corresponding channel ch.1 of the ink-jet head 1 is connected to the OUT terminal, and the drive pulse signal DP1 is output from the OUT terminal to the electrode 19.

In the channel drive circuit 33-1, the respective input terminals, namely the LVIN terminal, the VAP terminal, the GND terminal, and the VAN terminal are connected to the output terminal, namely the OUT terminal via first to fourth connecting circuits 411, 412, 413, and 414, respectively. As the first to fourth connecting circuits 411, 412, 413, and 414, switching elements such as PMOS transistors or NMOS transistors are used. In addition, a high-impedance switching element which has high internal resistance is employed as the first connecting circuit 411 which is interposed between the LVIN terminal and the OUT terminal, and low-impedance switching elements which have lower internal resistance than that of the high-impedance switching element are employed as the others, namely the second to fourth connecting circuits 412, 413, and 414.

A drive control signal DR1 of the channel ch.1 is divided into four systems DR1a, DR1b, DR1c, and DR1d and input from the logic unit 31 to the channel drive circuit 33-1.

The first system drive control signal DR1a is converted into high voltage by a first level shifter 421 and then supplied to the first connecting circuit 411 via a first pre-buffer 431. The second system drive control signal DR1b is converted into high voltage by a second level shifter 422 and then supplied to the second connecting circuit 412 via a second pre-buffer 432. The third drive control signal DR1c is converted into high voltage by a third level shifter 423 and then supplied to a third connecting circuit 413 via a third pre-buffer 433. The fourth system drive control signal DR1d is converted into high voltage by a fourth level shifter 424 and then supplied to the connecting circuit 414 via a fourth pre-buffer 434.

The first to fourth connecting circuits 411, 412, 413, and 414 are configured such that both terminals are connected to each other if the supplied drive control signals DR1a, DR1b, DR1c, and DR1d are turned on and both terminals are disconnected from each other if the supplied drive control signals DR1a, DR1b, DR1c, and DR1d are turned off. That is, the first system drive control signal DR1a is output while turned on in a case of connecting the first connecting circuit 411, namely in a case of applying the LV voltage to the OUT terminal. The second system drive control signal DR1b is output while turned on in a case of connecting the second connecting circuit 412, namely in a case of applying the VAP voltage to the OUT terminal. The third system drive control signal DR1c is output while turned on in a case of connecting the third connecting circuit 413, namely in a case of applying the GND level to the OUT terminal. The fourth system drive control signal DR1d is output while turned on in a case of connecting the fourth connecting circuit 414, namely in a case of applying the VAN voltage to the OUT terminal.

Figure 3:
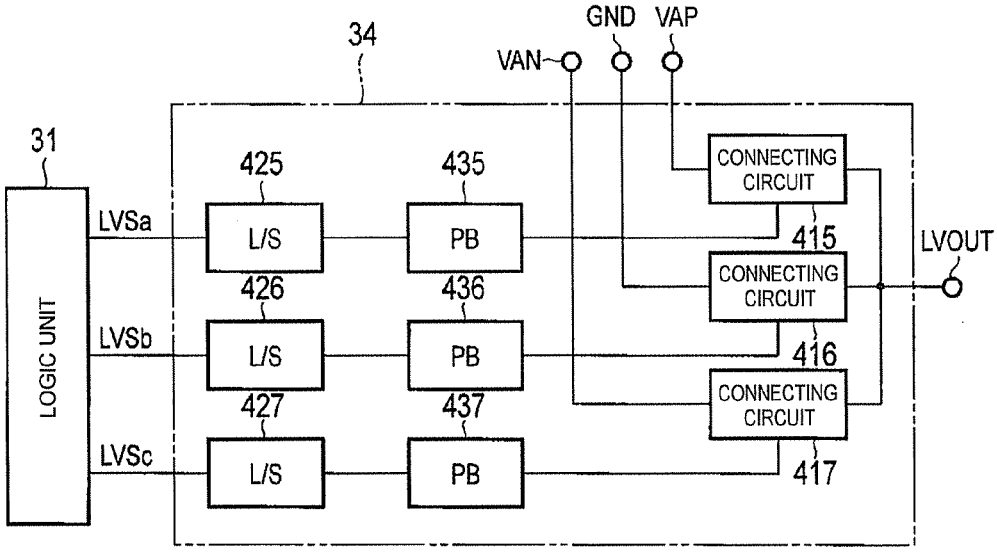
FIG. 3 is a configuration diagram of a load voltage selecting circuit.

FIG. 3 is a configuration diagram of the load voltage selecting circuit 34. The load voltage selecting circuit 34 includes a VAP terminal, a VAN terminal, and a GND terminal as input terminals and an LVOUT terminal as an output terminal. The LVOUT terminal is connected to the LVIN terminal by the signal line L.

In the load voltage selecting circuit 34, the respective input terminals, namely the VAP terminal, the GND terminal, and the VAN terminal are connected to the output terminal, namely the LVOUT terminal via fifth to seventh connecting circuits 415, 416, and 417, respectively. As the fifth to seventh connecting circuits 415, 416, and 417, switching elements such as PMOS transistors or NMOS transistors are used. In addition, low-impedance switching elements which have low internal resistance are employed as the fifth to seventh connecting circuits 415, 416, and 417.

A load voltage selecting signal LVS is divided into three systems LVSa, LVSb, and LVSc and input from the logic unit 31 to the load voltage selecting circuit 34.

The first system load voltage selecting signal LVSa is converted into high voltage by a fifth level shifter 425 and then supplied to the fifth connecting circuit 415 via a fifth pre-buffer 435. The second system load voltage selecting signal LVSb is converted into high voltage by a sixth level shifter 426 and then supplied to the sixth connecting circuit 416 via a sixth pre-buffer 436. The third system load voltage selecting signal LVSc is converted into high voltage by a seventh level shifter 427 and then supplied to the seventh connecting circuit 417 via a seventh pre-buffer 437.

The fifth to seventh connecting circuits 415, 416, and 417 are configured such that both terminals are connected to each other if the supplied load voltage selecting signals LVSa, LVSb, and LVSc are turned on and both terminals are disconnected from each other if the supplied load voltage selecting signals LVSa, LVSb, and LVSc are turned off. That is, the first system selecting signal LVSa is output while turned on in a case of connecting the fifth connecting circuit 415, namely in a case of applying the VAP voltage to the LVOUT terminal. The second system selecting signal LVSb is output while turned on in a case of connecting the sixth connecting circuit 416, namely in a case of applying the GND level to the LVOUT terminal. The third system selecting signal LVSc is output while turned on in a case of connecting the seventh connecting circuit 417, namely in a case of applying the VAN voltage to the LVOUT terminal.

Figure 4:
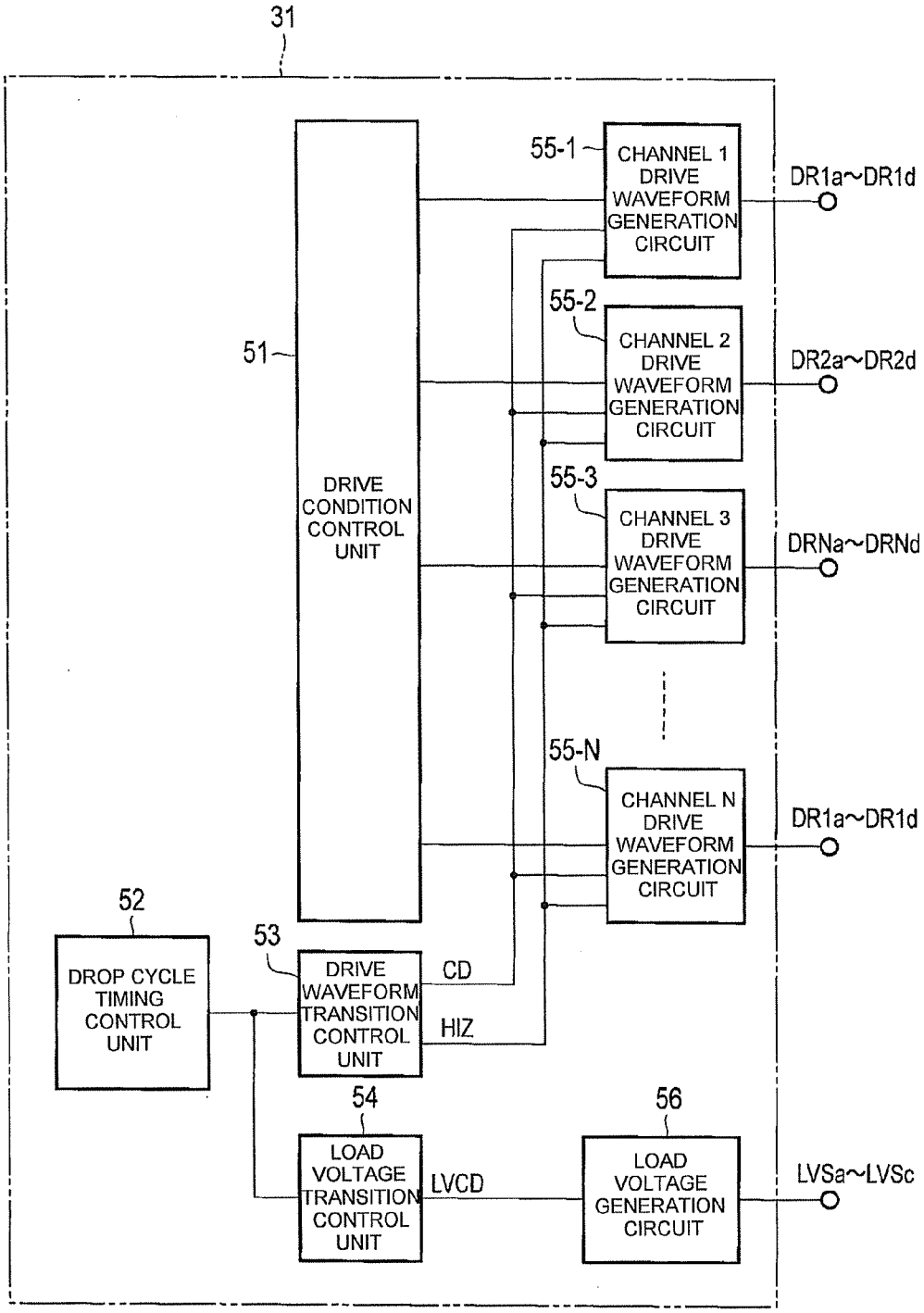
FIG. 4 is a configuration diagram of a logic unit.

FIG. 4 is a block diagram showing configurations of main components in the logic unit 31. The logic unit 31 includes a drive condition control unit 51, a drop cycle timing control unit 52, a drive waveform transition control unit 53 as a drive waveform transition control portion, a load voltage transition control unit 54 as a voltage transition control portion, and drive waveform generation circuits 55-1 to 55-N for the channels ch.1 to ch.N, respectively, and a load voltage generation circuit 56.

The drive condition control unit 51 determines ink ejection timing and the number of ejection times for each of the channels ch.1 to ch.N based on print data and a control parameter provided from a print control unit which is not shown in the drawing. In addition, the drive condition control unit 51 generates drive condition data for each of the channels ch.1 to ch.N in accordance with the determination content and supplies the drive condition data to the corresponding channel drive waveform generation circuits 55-1 to 55-N.

The drop cycle timing control unit 52 generates a drive enable signal DE and a cycle end signal CTIMEND based on timing information on the one-drop cycle Tt provided from the print control unit which is not shown in the drawing and outputs the drive enable signal DE and the cycle end signal CTIMEND to the drive waveform transition control unit 53 and the load voltage transition control unit 54.

The drive waveform transition control unit 53 commonly supplies drive waveform pattern data to the drive waveform generation circuits 55-1 to 55-N of the respective channels ch.1 to ch.N in synchronization with the drive enable signal DE and the cycle end signal CTIMEND input from the drop cycle timing control unit 52. The pattern data includes a drive waveform code group CD and a drive waveform high-impedance signal group HIZ.

The load voltage transition control unit 54 supplies a load voltage control code LVCD, which indicates a load voltage switching pattern, to the load voltage generation circuit 56 in synchronization with the drive enable signal DE and the cycle end signal CTIMEND input from the aforementioned drop cycle timing control unit 52.

The drive waveform generation circuits 55-1 to 55-N for the respective channel ch.1 to ch.N generate the drive control signals DR1 to DRN of the corresponding channels ch.1 to ch.N based on the drive condition data supplied from the drive condition control unit 51 and the drive waveform pattern data (the drive waveform code group CD and the drive waveform high-impedance signal group HIZ) supplied from the drive waveform transition control unit 53. The generated drive control signals DR1 to DRN are divided into four systems and output to the corresponding channel drive circuits 33-1 to 33-N.

The load voltage generation circuit 56 generates the load voltage selecting signal LVS in accordance with the load voltage control code LVCD supplied from the load voltage transition control unit 54. The generated load voltage selecting signal LVS is divided into three systems and output to the load voltage selecting circuit 34.

Figure 5:
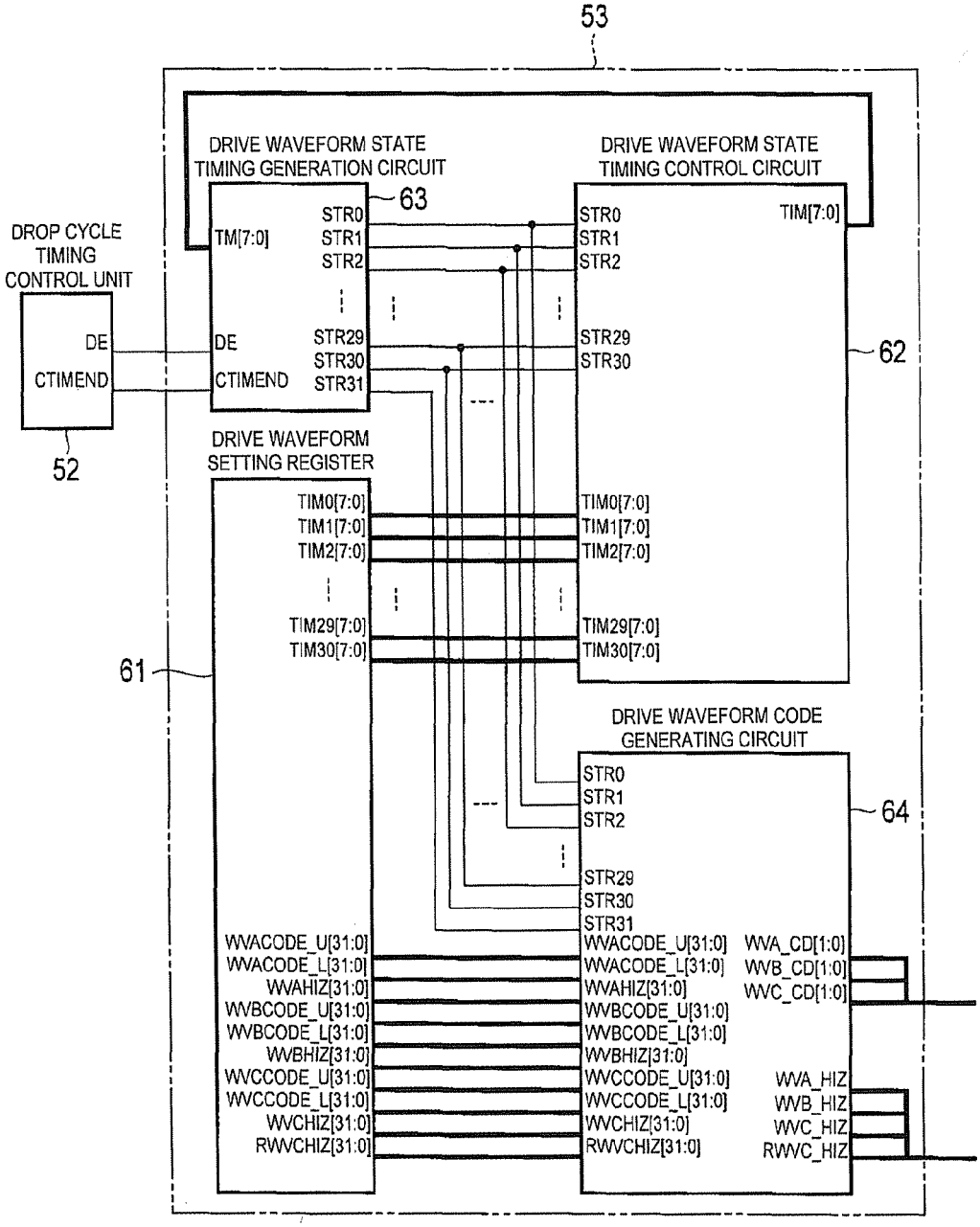
FIG. 5 is a configuration diagram of a drive waveform transition control unit.

FIG. 5 is a configuration diagram of the drive waveform transition control unit 53. The drive waveform transition control unit 53 includes a drive waveform setting register 61, a drive waveform state timing control circuit 62, a drive waveform state timing generation circuit 63, and a drive waveform code generation circuit 64.

For the drive waveform setting register 61, drive waveform state timing setting data TIM0 to TIM30 and drive waveform code setting data are set.

The drive waveform state timing control circuit 62 generates the drive waveform state timing data TIM based on the setting data TIM0 to TIM30 received from the drive waveform setting register 61 and supplies the drive waveform state timing data TIM to the drive waveform state timing generation circuit 63.

The drive waveform state timing generation circuit 63 generates 32-bit drive waveform state timing signals STR0 to STR31 from the drive waveform state timing data TIM in synchronization with the drive enable signal DE and the cycle end signal CTIMEND input from the drop cycle timing control unit 52. Then, the drive waveform state timing generation circuit 63 outputs the generated drive waveform state timing signals STR0 to STR30 to the drive waveform state timing control circuit 62 and outputs the generated drive waveform state timing signals STR0 to STR31 to the drive waveform code generation circuit 64.

The drive waveform code generation circuit 64 generates drive waveform code groups WVA_CD, WVB_CD, and WVC_CD and drive waveform high-impedance signal groups WVA_HIZ, WVB_HIZ, WVC_HIZ, and RWVC_HIZ, based on the drive waveform code setting data received from the drive waveform setting register 61 and the drive waveform state timing signals STR0 to STR31 input from the drive waveform state timing generation circuit 63. Then, the drive waveform code generation circuit 64 commonly outputs the generated drive waveform code groups WVA_CD, WVB_CD, and WVC_CD and the drive waveform high-impedance signal groups WVA_HIZ, WVB_HIZ, WVC_HIZ, and RWVC_HIZ to the drive waveform generation circuits 55-1 to 55-N of the respective channels.

Figure 6:
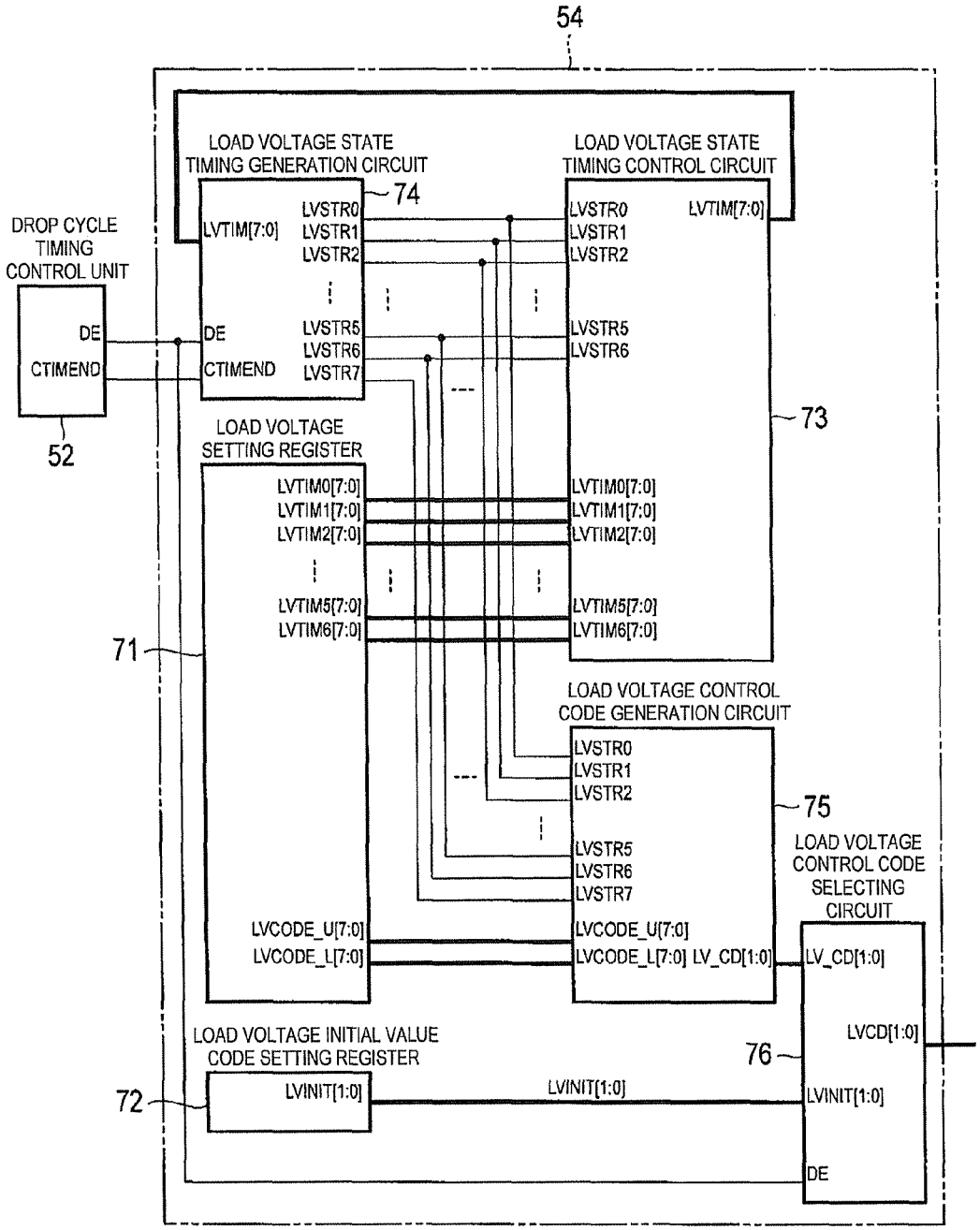
FIG. 6 is a configuration diagram of a load voltage transition control unit.

FIG. 6 is a configuration diagram of the load voltage transition control unit 54. The load voltage transition control unit 54 includes a load voltage setting register 71, a load voltage initial value code setting register 72 as an initial voltage setting portion, a load voltage state timing control circuit 73, a load voltage state timing generation circuit 74, a load voltage control code generation circuit 75, and a load voltage control code selecting circuit 76.

For the load voltage setting register 71, load voltage state timing setting data LVTIM0 to LVTIM6 and load voltage control code setting data are set. For the load voltage initial value code setting register 72, a load voltage initial value LNINIT is set.

The load voltage state timing control circuit 73 generates load voltage state timing data LVTIM based on the setting data LVTIM0 to LVTIM6 received from the load voltage setting register 71 and supplies the load voltage state timing data LVTIM to the load voltage state timing generation circuit 74.

The load voltage state timing generation circuit 74 generates 8-bit load voltage state timing signals LVSTR0 to LVSTR7 from the load voltage state timing data LVTIM in synchronization with the drive enable signal DE and the cycle end signal CTIMEND input from the drop cycle timing control unit 52. Then, the load voltage state timing generation circuit 74 outputs the generated load voltage state timing signals LVSTR0 to LVSTR6 to the load voltage state timing control circuit 73 and outputs the generated load voltage state timing signals LVSTR0 to LVSTR7 to the load voltage control code generation circuit 75.

The load voltage control code generation circuit 75 generates a load voltage control code LV_CD based on the load voltage control code setting data LVCODE received from the load voltage setting register 71 and the load voltage state timing signals LVSTR0 to LVSTR7 input from the load voltage state timing generation circuit 74. Then, the load voltage control code generation circuit 75 outputs the generated load voltage control code LV_CD to the load voltage control code selecting circuit 76.

The load voltage control code selecting circuit 76 selects any one of the load voltage initial value LNINIT received from the load voltage initial value code setting register 72 and the load voltage control code LV_CD supplied from the load voltage control code generation circuit 75 and supplies the selected load voltage initial value LNINIT or the selected load voltage control code LV_CD as a load voltage control code LVCD to the load voltage generation circuit 56.

Figure 7:
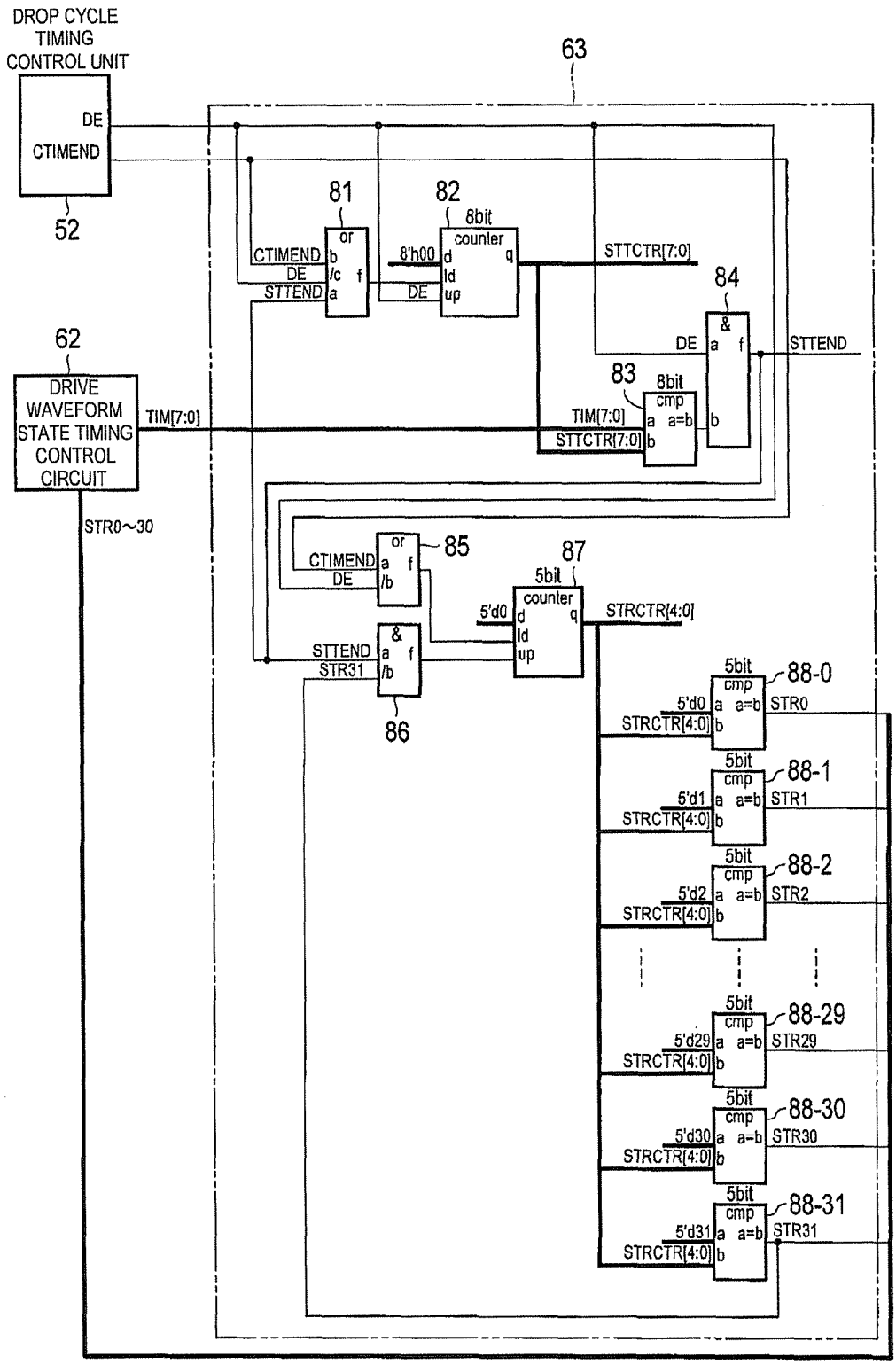
FIG. 7 is a circuit diagram of a drive waveform state timing generation circuit.

FIG. 7 is a circuit diagram of the drive waveform state timing generation circuit 63. The drive waveform state timing generation circuit 63 includes an OR circuit 81, an 8-bit counter 82, a comparator 83, an AND gate 84, an OR gate 85, an AND gate 86, a 5-bit counter 87, and 32 comparators 88-0 to 88-31, and wiring is provided as shown in FIG. 7.

Figure 8:
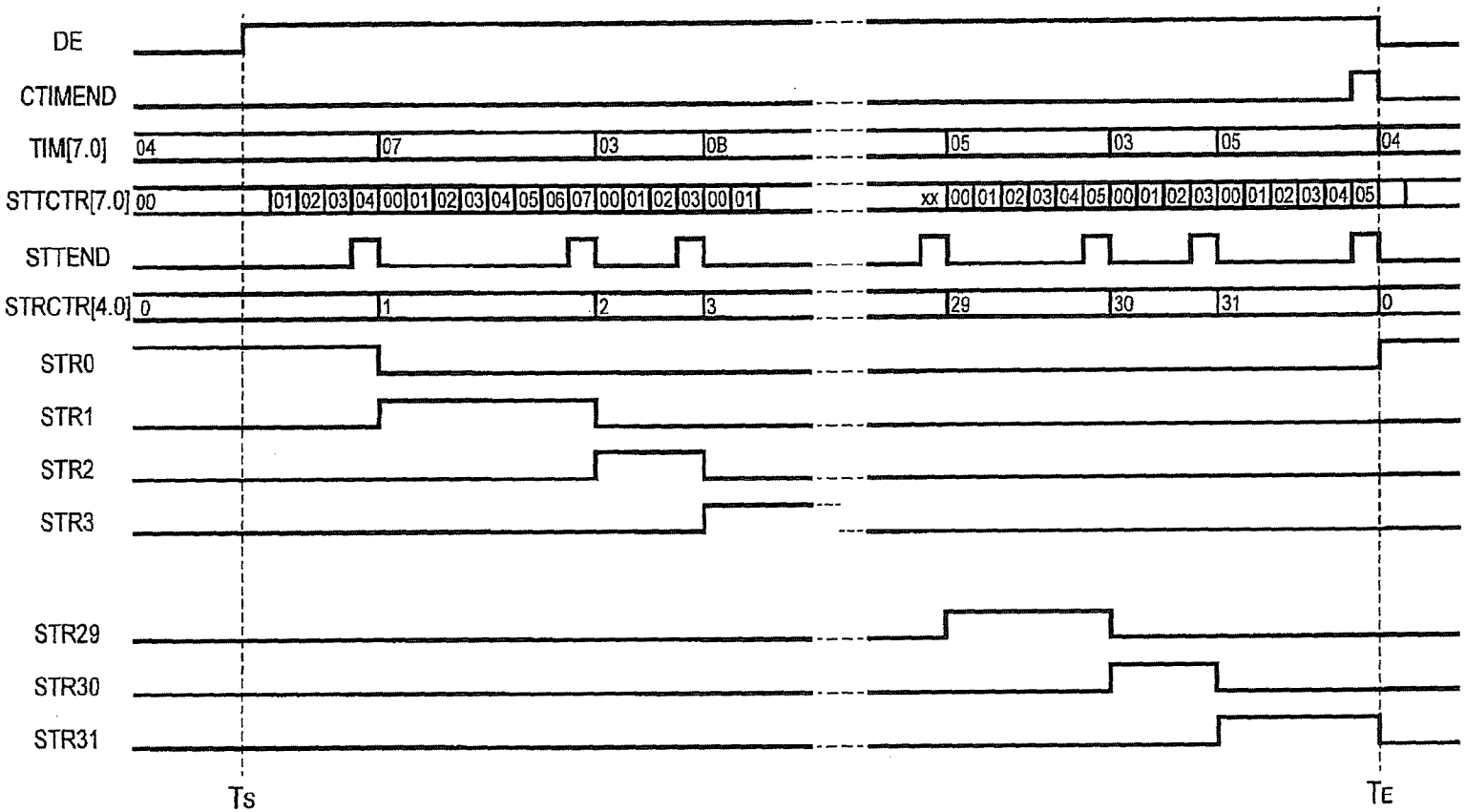
FIG. 8 is a timing diagram of main signals in the drive waveform state timing generation circuit in FIG. 7.

FIG. 8 is a timing diagram of main signals in the drive waveform state timing generation circuit 63. In the drawing, a signal DE is a drive enable signal input from the drop cycle timing control unit 52. A signal CTIMEND is a cycle end signal input from the drop cycle timing control unit 52. Data TIM [7:0] is drive waveform state timing data supplied from the drive waveform state timing control circuit 62. Data STTCTR [7:0] is state timing control data output from the 8-bit counter 82. A signal STTEND is a state end signal output from the AND gate 84. Data STRCTR [4:0] is state count data output from the 5-bit counter 87. Respective signals STR0 to STR31 are drive waveform state timing signals output from the respective comparators 88-0 to 88-31.

As shown in FIG. 8, the 8-bit counter 82 performs a counting operation at a predetermined timing and outputs the state timing control data STTCTR [7:0] corresponding to the count value until the cycle end signal CTIMEND is input after the drive enable signal DE is input to the OR gate 81 (sections TS to TE). The comparator 83 outputs a match signal if the value of the state timing control data STTCTR [7:0] coincides with the value of the drive waveform state timing data TIM [7:0]. The AND gate 84 outputs the state end signal STTEND if the match signal is input thereto from the comparator 83. The 8-bit counter 82 once resets the count value if the state end signal STTEND is input thereto via the OR gate 81 and, thereafter, restarts the counting operation at a predetermined timing.

In addition, the 5-bit counter 87 counts the number of occurrences of the state end signal STTEND to be input via the AND gate 86 until the cycle end signal CTIMEND is input thereto after the drive enable signal DE is input to the OR gate 85 (sections TS to TE). Then, the 5-bit counter 87 outputs the state count data STRCTR [4:0] corresponding to the count value to the respective comparators 88-0 to 88-31.

The comparator 88-0 outputs the drive waveform state timing signal STR0 if the state count data STRCTR [4:0] is "0". The comparator 88-1 outputs the drive waveform state timing signal STR1 if the state count data STRCTR [4:0] is "1". The comparator 88-2 outputs the drive waveform state timing signal STR2 if the state count data STRCTR [4:0] is "2". The same is true to the other comparators 88-3 to 88-31, and for example, the comparator 88-31 outputs the drive waveform state timing signal STR31 if the state count data STRCTR [4:0] is "31".

The drive waveform state timing signals STR0 to STR30 among outputs from the respective comparators 88-0 to 88-31 are output to the drive waveform state timing control circuit 62 for generation of the drive waveform state timing data TIM [7:0]. Similarly, the drive waveform state timing signals STR0 to STR31 are output to the drive waveform code generation circuit 64 for generation of the drive waveform code.

Figure 9:
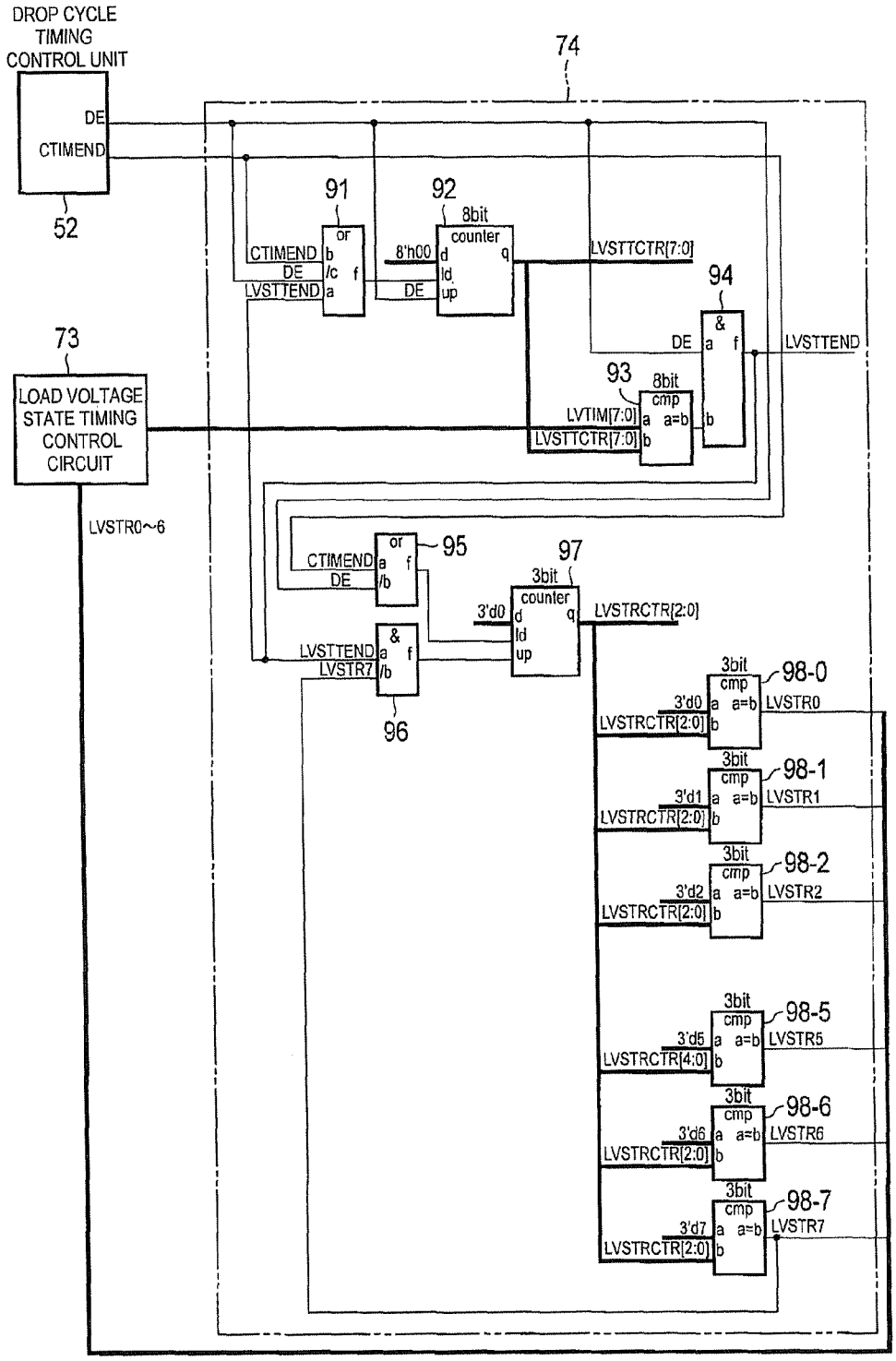
FIG. 9 is a circuit diagram of a load voltage state timing generation circuit.

FIG. 9 is a circuit diagram of the load voltage state timing generation circuit 74. The load voltage state timing generation circuit 74 includes an OR circuit 91, an 8-bit counter 92, a comparator 93, an AND gate 94, an OR gate 95, an AND gate 96, a 3-bit counter 97, and eight comparators 98-0 to 98-7, and wiring is provided as shown in FIG. 9.

Figure 10:
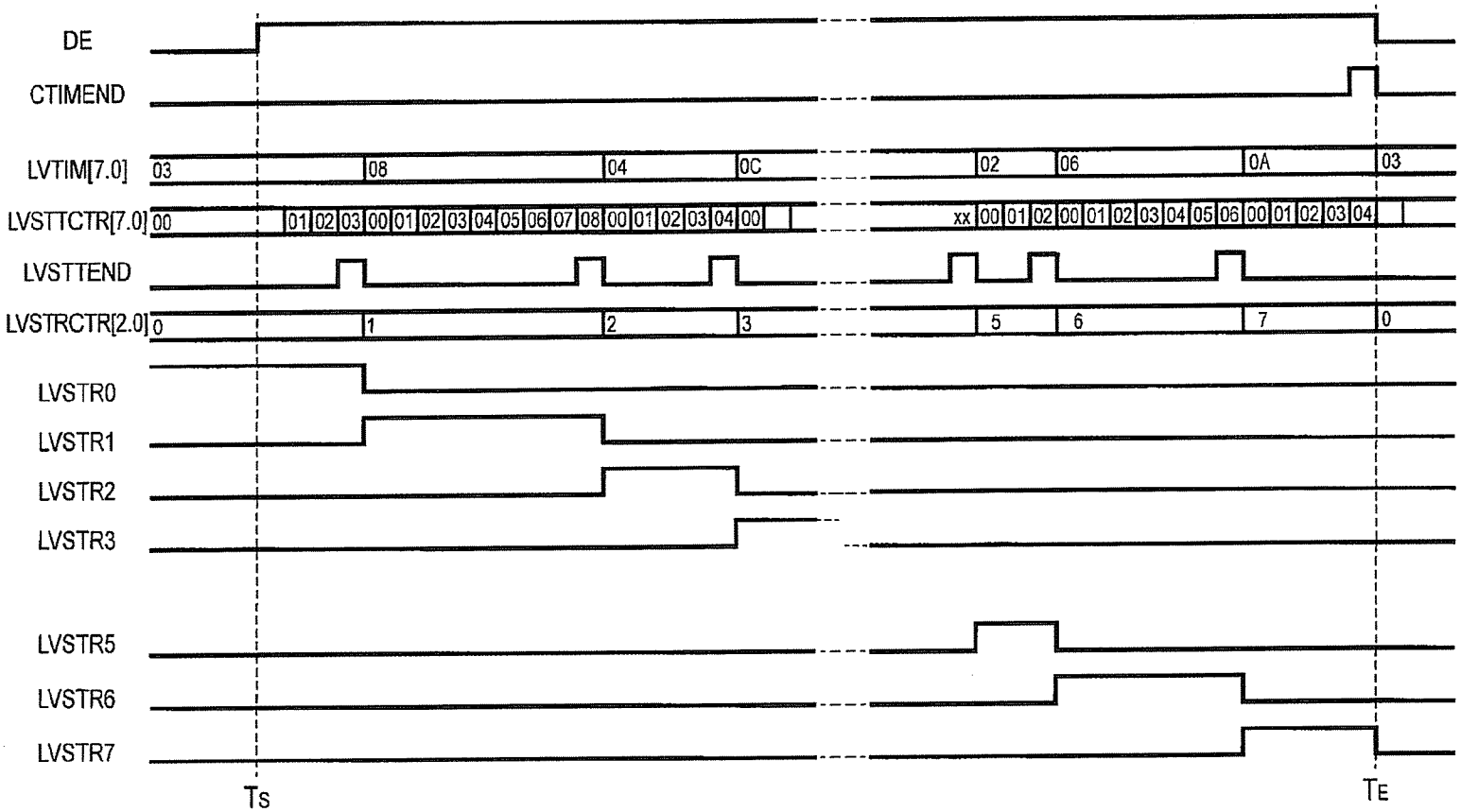
FIG. 10 is a timing diagram of main signals in the load voltage state timing generation circuit in FIG. 9.

FIG. 10 is a timing diagram of main signals in the load voltage state timing generation circuit 74. In the drawing, a signal DE is a drive enable signal input from the drop cycle timing control unit 52. A signal CTIMEND is a cycle end signal input from the drop cycle timing control unit 52. Data LVTIM [7:0] is load voltage state timing data supplied from the load voltage state timing control circuit 73. Data LVSTTCTR [7:0] is load voltage state timing control data output from the 8-bit counter 92. A signal LVSTTEND is a load voltage state end signal output from the AND gate 94. Data LVSTRCTR [2:0] is load voltage state count data output from the 3-bit counter 97. Respective signals LVSTR0 to LVSTR7 are load voltage state timing signals output from the respective comparators 98-0 to 98-7.

As shown in FIG. 10, the 8-bit counter 92 performs a counting operation at a predetermined timing and outputs the load voltage state timing control data LVSTTCTR [7:0 corresponding to the count value until the cycle end signal CTIMEND is input after the drive enable signal DE is input to the OR gate 91 (sections TS to TE). The comparator 93 outputs a match signal if the value of the load voltage state timing control data LVSTTCTR [7:0] coincides with the value of the load voltage state timing data LVTIM [7:0]. The AND gate 94 outputs the load voltage state end signal LVSTTEND if the match signal is input thereto from the comparator 93. The 8-bit counter 92 once resets the count value if the load voltage state end signal LVSTTEND is input thereto via the OR gate 91 and, thereafter, restarts the counting operation at a predetermined timing.

In addition, the 3-bit counter 97 counts the number of occurrences of the load voltage state end signal LVSTTEND input via the AND gate 96 until the cycle end signal CTIMEND is input after the drive enable signal DE is input to the OR gate 95 (sections TS to TE). Then, the 3-bit counter 97 outputs the load voltage state count data LVSTRCTR [2:0] corresponding to the count value to the respective comparators 98-0 to 98-7.

The comparator 98-0 outputs the load voltage state timing signal LVSTR0 if the load voltage state count data LVSTRCTR [2:0] is "0". The comparator 98-1 outputs the load voltage state timing signal LVSTR1 if the load voltage state count data LVSTRCTR [2:0] is "1". The same is true to the other comparators 98-2 to 98-7, and for example, the comparator 98-7 outputs the load voltage state timing signal LVSTR7 if the load voltage state count data LVSTRCTR [2:0] is "7".

The load voltage state timing signals LVSTR0 to LVSTR6 among the outputs from the respective comparators 98-0 to 98-7 are output to the load voltage state timing control circuit 73 for generation of the load voltage state timing data LVTIM [7:0]. Similarly, the load voltage state timing signals STR0 to STR7 are output to the load voltage control code generation circuit 75 for generation of the load voltage control code.

As described above, the control timing of the drive waveform transition control unit 53 and the control timing of the load voltage transition control unit 54 share the drop cycle time until the cycle end signal CTIMEND is input after the drive enable signal DE is input. However, state time in the drop cycle is controlled based on an independent time axis.

A first pattern example of the drive waveform code group and the drive waveform high-impedance signal group generated by the drive waveform code generation circuit 64 will be shown in FIG. 11, and a second pattern example thereof will be shown in FIG. 14.

In FIGS. 11 and 14, "STATE" represents the drive waveform state timing signals STR0 to STR31 generated by the drive waveform state timing generation circuit 63. "TIM (μsec)" represents the drive waveform state timing setting data TIM0 to TIM30 set to the drive waveform setting register 61. "WV-A" represents a drive waveform code "HOME" and a drive waveform high-impedance signal "HOMEHi-Z" for the channel ch.i as a target of ink ejection. "WV-B" represents drive waveform codes "NEIGHBOR" and drive waveform high-impedance signals "NEIGHBORHi-Z" for the adjacent channels ch.i−1 and ch.i+1 on both sides of the channel ch.i as the target of the ink ejection.

In addition, a value "0" of the drive waveform codes "HOME" and "NEIGHBOR" is a code for outputting a third system drive control signal DRic in an ON state among drive control signals DRi generated by the corresponding drive waveform generation circuit 55-*i*. A value "1" is a code for outputting a second system drive control signal Drib in an ON state among the drive control signals DRi. A value "2" is a code for outputting a fourth system drive control signal DRid in an ON state among the drive control signals DRi. A value "3" is a code for outputting a first system drive control signal DRia in an ON state among the drive control signals DRi.

In addition, a value "0" of the drive waveform high-impedance signal "HOMEHi-Z" and "NEIGHBORHi-Z" is a signal for performing control such that the drive control signals DRia to DRid generated with the corresponding drive waveform codes "HOME" and "NEIGHBOR" are output from the drive waveform generation circuit 55-*i* to the corresponding channel drive circuit 33-*i*, and a value "1" is a signal for performing control such that the drive control signals DRia to DRid are not output.

FIG. 12 shows a pattern example of the load voltage control code generated by the load voltage control code generation circuit 75 in the first pattern example. In addition, FIG. 15 shows a pattern example of the load voltage control code generated by the load voltage control code generation circuit 75 in the second pattern example.

In FIGS. 12 and 15, "LVSTR" represents load voltage state timing signals LVSTR0 to LVSTR7 generated by the load voltage state timing generation circuit 74. "LVTIM (sec)" represents load voltage waveform state timing setting data LVTIM0 to LVTIM7 set to the load voltage setting register 71. "LV_CD" represents a load voltage control code LV_CD generated by the load voltage control code generation circuit 75 based on the corresponding load voltage state timing signals LVSTR0 to LVSTR7 and the load voltage control code setting data LVCODE. A value "0" of the load voltage control code LV_CD is a code for outputting a second system selecting signal LVSb in an ON state among the load voltage selecting signals LVS generated by the load voltage generation circuit 56. A value "1" is a code for outputting a first system selecting signal LVSa in an ON state among the load voltage selecting signals LVS. A value "2" is a code for outputting a third system selecting signal LVSc in an ON state among the load voltage selecting signals LVS.

Figure 13:
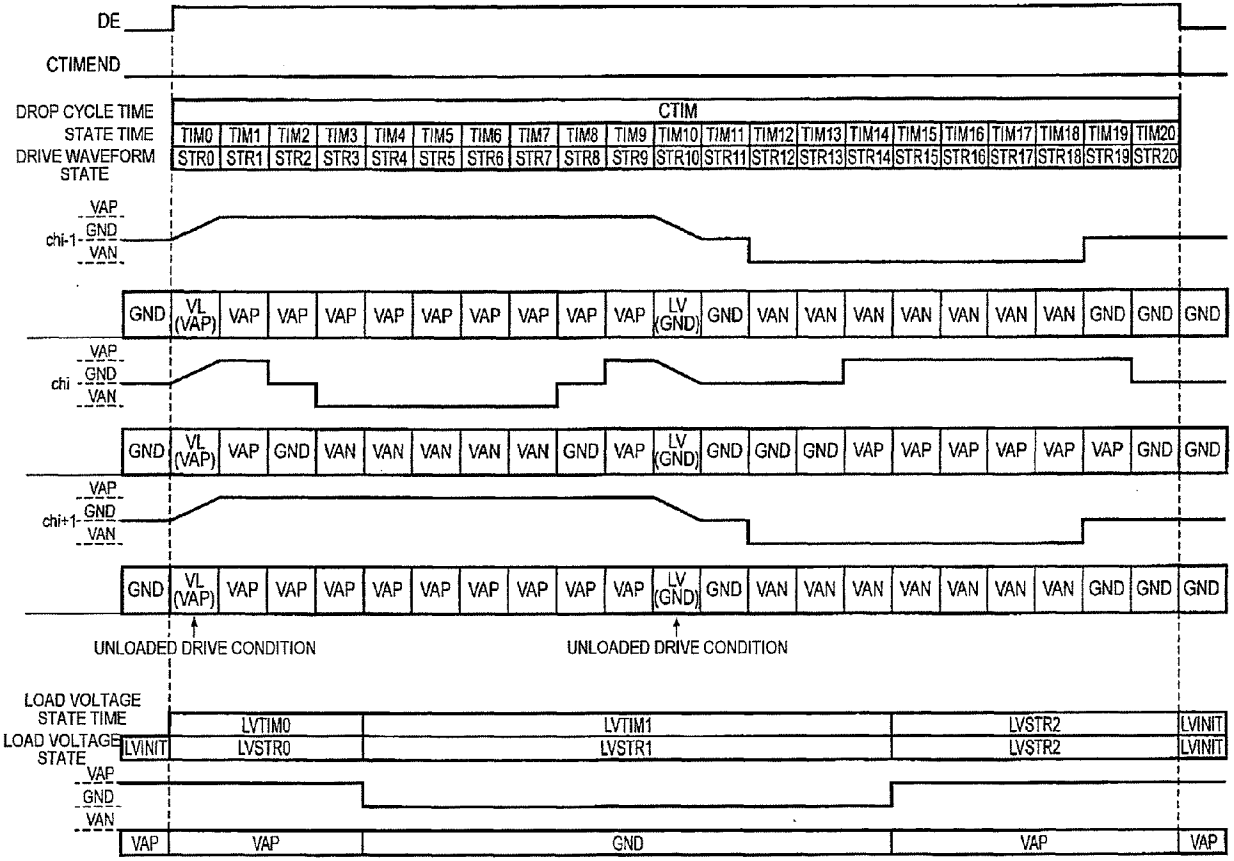
FIG. 13 is a timing diagram showing drive pulse signals DPi−1, DPi, and DPi+1 for an ink ejection channel ch.i and channels ch.i−1 and ch.i+1 adjacent to the ink ejection channel ch.i in the first pattern example.
Figure 16:
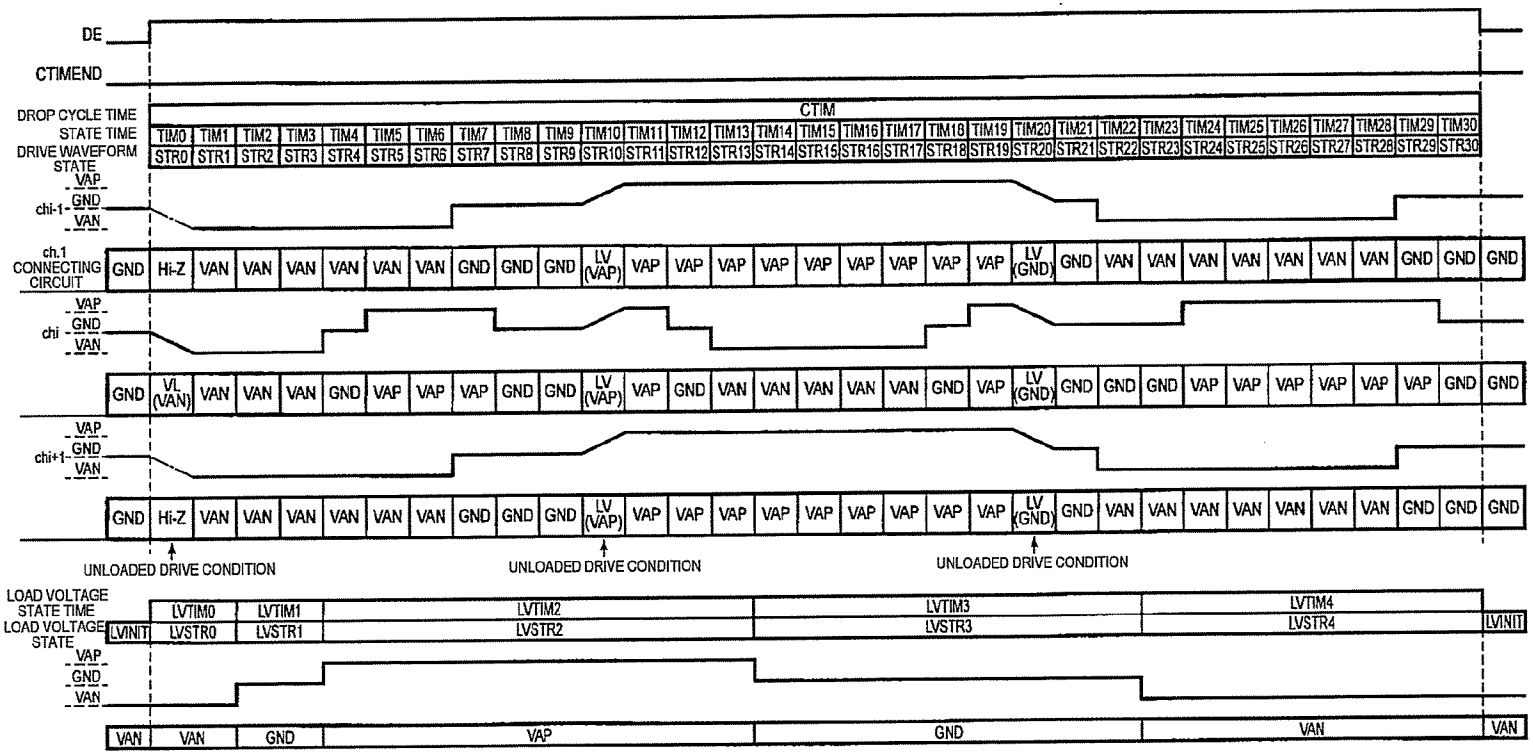
FIG. 16 is a timing diagram showing the drive pulse signals DPi−1, DPi, and DPi+1 for the ink ejection channel ch.i and the channels ch.i−1 and ch.i+1 adjacent to the ink ejection channel ch.i in the second pattern example.

FIG. 13 shows drive pulse signals DPi−1, DPi, and DPi+1 for the ink ejection channel ch.i and the channels ch.i−1 and ch.i+1 adjacent thereto in the first pattern example. In addition, FIG. 16 shows drive pulse signals DPi−1, DPi, and DPi+1 for the ink ejection channel ch.i and the channels ch.i−1 and ch.i+1 adjacent thereto in the second pattern example.

Hereinafter, a description will be given of actions of the ink-jet head drive device 30 on both the first pattern example and the second pattern example. First, a description will be given of the action of the ink-jet head drive device 30 on the first pattern example with reference to FIGS. 11 to 13.

Before the start of the drop cycle, the third system drive control signal DR1c is output from the drive waveform generation circuits 55-(*i*−1), 55-*i*, and 55-(*i*+1) to the corresponding drive circuits 33-(*i*−1), 33-*i*, and 33-(*i*+1). In doing so, the third connecting circuit 413 is turned on at all the drive circuits 33-(*i*−1), 33-*i*, and 33-(*i*+1). As a result, potential of the drive pulse signals DPi−1, DPi, and DPi+1 is brought into a GND level.

At this time, the load voltage initial value LNINIT set to the load voltage initial value code setting register 72 is selected by the load voltage control code selecting circuit 76. In the first example, the load voltage initial value LNINIT is "1". Therefore, the first system selecting signal LVSa is output from the load voltage generation circuit 56 to the load voltage selecting circuit 34. In doing so, the VAP voltage is selected as the load voltage LV by the load voltage selecting circuit 34.

If the drive enable signal DE is output from the drop cycle timing control unit 52 and the drive waveform state is brought into an initial state STR0, all the drive waveform code for the channel ch.1 as the target of ink ejection and the drive waveform codes for channels ch.i−1 and ch.i+1 on both sides thereof are "3" as shown in FIG. 11, and therefore, the first system drive control signal DR1a is output from the drive waveform generation circuits 55-(*i*−1), 55-*i*, and 55-(*i*+1) to the corresponding drive circuits 33-(*i*−1), 33-*i*, and 33-(*i*+1). In doing so, the first connecting circuit 411 is turned on at all the drive circuits 33-(*i*−1), 33-*i*, and 33-(*i*+1). As a result, potential of the drive pulse signals DPi−1, DPi, and DPi+1 are raised to the input voltage to the LVIN terminal, namely to the VAP voltage.

Similarly, if the drive enable signal DE is output and the load voltage state is brought into the initial state LVSTR0, the load voltage control code LVCD is "1" as shown in FIG. 12, and therefore, the first system selecting signal LVSa is continuously output from the load voltage generation circuit 56. In doing so, the VAP voltage is continuously selected as the load voltage LV by the load voltage selecting circuit 34.

If the time of the drive waveform state timing setting data TIM0 passes and the drive waveform state is brought into a first stage STR1, the drive waveform code for the channel ch.i and the drive waveform codes for the channel ch.i−1 and ch.i+1 are "1" as shown in FIG. 11, and therefore, the second drive control signal DR1b is output from the drive waveform generation circuits 55-(*i*−1), 55-*i*, and 55-(*i*+1) to the corresponding drive circuits 33-(*i*−1), 33-*i*, and 33-(*i*+1). In doing so, the second connecting circuits 412 are turned on at all the drive circuits 33-(*i*−1), 33-*i*, and 33-(*i*+1). As a result, potential of the drive pulse signals DPi−1, DPi, and DPi+1 are maintained at the VAP voltage.

If the time of the drive waveform state timing setting data TIM1 passes and the drive waveform state is brought into a second stage STR2, the drive waveform code for the channel ch.i becomes "0", and the drive waveform codes for the channels ch.i−1 and ch.i+1 are maintained at "1". Therefore, the third system drive control signal DR1c is output from the drive waveform generation circuit 55-*i* to the corresponding drive circuit 33-*i*. No change occurs in the drive signals to be output to the drive circuits 33-(*i*−1) and 33-(*i*+1). In doing so, the third connecting circuit 413 is turned on at the drive circuit 33-*i*. As a result, potential of the drive pulse signals DPi−1 and DPi+1 is maintained at the VAP voltage while potential of the drive pulse signal DPi falls to the GND level.

If the time of the drive waveform state timing setting data TIM2 passes and the drive waveform state is brought into a third stage STR3, only the drive waveform code for the channel ch.i becomes "2". For this reason, the fourth system drive control signal DR1d is output from the drive waveform generation circuit 55-*i* to the corresponding drive circuit 33-*i*. In doing so, the fourth connecting circuit 414 is turned on at the drive circuit 33-*i*. As a result, potential of the drive pulse signals DPi−1 and DPi+1 is maintained at the VAP voltage while potential of the drive pulse signal DPi falls to the VAN level.

As described above, the partition walls 28*a* and 28*b* on both sides of the ink chamber 22 of the channel ch.i are deformed outward, the volume of the ink chamber 22 is expanded, and the ink flows from the common ink chamber 21 to the ink chamber 22.

Thereafter, no change occurs in the drive waveform code for the channel ch.i and the drive waveform codes for the channels ch.i−1 and ch.i+1 from a fourth stage STR4 to a seventh stage STR7 of the drive waveform state. Therefore, potential of the drive pulse signal DPi is maintained at the VAN voltage, and potential of the drive pulse signals DPi−1 and DPi+1 is maintained at the VAP voltage. As a result, the ink chamber 22 of the channel ch.i is maintained in the expanded state.

On the other hand, if the time of the load voltage waveform state timing setting data LVTIM0 passes and the load voltage state is brought into a first state LVSTR1, the load voltage control code LVCD is "0" as shown in FIG. 12, and therefore, the second system selecting signal LVSb is output from the load voltage generation circuit 56. In doing so, the GND level is selected as the load voltage LV by the load voltage selecting circuit 34.

If the drive waveform state is brought into an eighth stage STR8, the drive waveform code for the channel ch.i becomes "0" as shown in FIG. 11, and the drive waveform codes for the channels ch.i−1 and ch.i+1 are maintained at "1". Therefore, the third connecting circuit 413 is turned on at the drive circuit 33-*i*, and potential of the drive pulse signal DPi is raised to the GND level.

If the drive waveform state is brought into a ninth stage STR9, the drive waveform code for the channel ch.i becomes "1". The drive waveform codes for the channels ch.i−1 and ch.i+1 do not vary from "1". Therefore, the second connecting circuit 412 is turned on at the drive circuit 33-*i*, and potential of the drive pulse signal DPi is raised to the VAP voltage. At this time, potential of the drive pulse signals DPi−1 and DPi+1 is also the VAP voltage. Therefore, the partition walls 28*a* and 28*b* on both sides of the ink chamber 22 corresponding to the channel ch.i are recovered to the stationary state. By such recovery, pressure in the ink chamber 22 increases. Therefore, an ink droplet is ejected from the nozzle 23 corresponding to the ink chamber 22.

If the drive waveform state is brought into a tenth stage STR10, all the waveform code for the channel ch.i and the drive waveform codes for the channels ch.i−1 and ch.i+1 become "3". Therefore, the first system drive control signal DR1a is output from all the drive waveform generation circuits 55-(*i*−1), 55-*i*, and 55-(*i*+1) to the corresponding drive circuits 33-(*i*−1), 33-*i*, and 33-(*i*+1). In doing so, the first connecting circuit 411 is turned on at all the drive circuits 33-(*i*−1), 33-*i*, and 33-(*i*+1). As a result, potential of the drive pulse signals DPi−1, DPi, and DPi+1 falls to the input voltage to the LVIN terminal, namely the GND level.

If the drive waveform state is brought into an eleventh stage STR11, all the drive waveform code for the channel ch.i and the drive waveform codes for the channels ch.i−1 and ch.i+1 become "0". Therefore, the third system drive control signal DR1c is output from all the drive waveform generation circuits 55-(*i*−1), 55-*i*, and 55-(*i*+1) to the corresponding drive circuits 33-(*i*−1), 33-*i*, and 33-(*i*+1). In doing so, the third connecting circuit 413 is turned on at all the drive circuits 33-(*i*−1), 33-*i*, and 33-(*i*+1). As a result, potential of the drive pulse signals DPi−1, DPi, and DPi+1 is maintained at the GND level.

If the drive waveform state is brought into a twelfth state STR12, the drive waveform code for the channel ch.i is maintained at "0" while the drive waveform codes for the channels ch.i−1 and ch.i+1 become "2". Therefore, the fourth system drive control signal DR1d is output from the drive waveform generation circuits 55-(*i*−1) and 55-(*i*+1) to the corresponding drive circuits 33-(*i*−1) and 33-(*i*+1). No change occurs in the drive signal output to the drive circuit 33-*i*. In doing so, the fourth connecting circuit 414 is turned on at the drive circuits 33-(*i*−1) and 33-(*i*+3). No change occurs in the drive circuit 33-*i*. As a result, potential of the drive pulse signal DPi is maintained at the GND level while potential of the drive pulse signals DPi−1 and DPi+1 falls to the VAN level.

The same action as that in the twelfth stage STR12 occurs in a thirteenth stage STR13 of the drive waveform state. In a fourteenth stage, the drive waveform code for the channel ch.i becomes "1". Therefore, the second connecting circuit 412 is turned on at the drive circuit 33-*i*. That is, potential of the drive pulse signal DPi is raised to the VAP voltage.

As described above, the partition walls 28*a* and 28*b* on both sides of the ink chamber 22 for the channel ch.i are respectively deformed inward so as to contract the volume of the ink chamber 22. By such deformation, the pressure in the ink chamber 22 further increases. Therefore, a steep decrease in pressure which occurs in the ink chamber 22 due to the ejection of the ink droplet is alleviated.

Thereafter, no change occurs in the drive waveform code for the channel ch.i and the drive waveform codes for the channels ch.i−1 and ch.i+1 from a fifteenth stage STR15 to an eighteenth stage STR18 of the drive waveform state. Therefore, potential of the drive pulse signal DPi is maintained at the VAP voltage while potential of the drive pulse signals DPi−1 and DPi+1 is maintained at the VAN voltage. That is, the ink chamber 22 of the channel ch.i is maintained in the contracted state.

On the other hand, if the time of the load voltage waveform state timing setting data LVTIM1 passes and the load voltage state is brought into the second stage LVSTR2, the load voltage control code LVCD is "1" as shown in FIG. 12, and therefore, the first system selecting signal LVSa is output from the load voltage generation circuit 56. In doing so, the VAP voltage is selected as the load voltage LV by the load voltage selecting circuit 34.

In a nineteenth stage STR19 of the drive waveform state, the drive waveform code for the channel ch.i is maintained at "1" while the drive waveform codes for the channels ch.i−1 and ch, i+1 become "0" as shown in FIG. 11. Therefore, the third connecting circuit 413 is turned on at the drive circuits 33-(*i*−1) and 33-(*i*+1), and potential of the drive pulse signals DPi−1 and DPi+1 is raised to the GND level.

In a twentieth stage STR20 of the drive waveform state, the drive waveform code for the channel ch.i also becomes "0". In doing so, the third connecting circuit 413 is turned on even at the drive circuit 33-*i*, and potential of the drive pulse signal DPi falls to the GND level. At this time, the cycle end signal CTIMEND is output from the drop cycle timing control unit 52, and a one-drop cycle is completed.

As shown in FIG. 13, all the drive pulse signal DPi for the channel ch.i as the target of ink ejection and the drive pulse signals DPi−1 and DPi+1 for the channels ch.i−1 and ch.i+1 on both sides thereof are raised from the GND level to the VAP voltage in the initial state STR0 of the drive waveform state. Therefore, voltage is equally applied to the electrodes 19 at both ends of the piezoelectric members 12 and 13 which form the partition walls of the ink chamber 22 corresponding to the channel ch.i. That is, the piezoelectric members 12 and 13 which form the partition walls 28*a* and 28*b* do not act as load capacity, and an unloaded state is obtained.

However, the first connecting circuit 411 is turned on at all the drive circuits 33-(*i*−1), 33-*i*, and 33-(*i*+1) at this time. That is, input voltage to the LVIN terminal is selected as the potential of the drive pulse signals DPi−1, DPi and DPi+1. At this time, the VAP voltage as the load voltage initial value is applied to the LVIN terminal. Therefore, all the drive pulse signals DPi−1, DPi and DPi+1 for the respective channels ch.i−1, ch.i, and ch.i+1 are raised from the GND level to the VAP voltage.

Here, a high-impedance switching element which has high internal resistance is employed as the first connecting circuit 411. Therefore, potential of the drive pulse signals DPi−1, DPi, and DPi+1 is gradually raised to the VAP level. Therefore, the voltage applied to the electrodes of the piezoelectric members 12 and 13 does not steeply change even if the piezoelectric members 12 and 13 are brought into the unloaded state.

In the tenth stage STR10 of the drive waveform state, all the drive pulse signal DPi for the channel ch.i as the target of ink ejection and the drive pulse signals DPi−1 and DPi+1 for the channels ch.i−1 and ch.i+1 on both sides thereof fall from the VAP voltage to the GND level. Therefore, voltage is equally applied to the electrodes 19 at both ends of the piezoelectric members 12 and 13 which form the partition walls of the ink chamber 22 corresponding to the channel ch.i. That is, the piezoelectric members 12 and 13 are still in the unloaded state.

However, the first connecting circuit 411 is turned on at all the drive circuits 33-(*i*−1), 33-*i*, and 33-(*i*+1) even at this time. That is, input voltage to the LVIN terminal is selected as the potential of the drive pulse signals DPi−1, DPi, and DPi+1. At this time, potential of the LVIN terminal is a value in the first stage LVSTR1, namely in the GND level. Therefore, all the drive pulse signals DPi−1, DPi, and DPi+1 for the respective channels ch.i−1, ch.i, and ch.i+1 fall from the VAP voltage to the GND level.

However, a high-impedance switching element which has a high internal resistance is employed as the first connecting circuit 411 as described above. Therefore, potential of the drive pulse signals DPi−1, DPi, and DPi+1 gradually falls to the GND level, and therefore, voltage applied to the piezoelectric members 12 and 13 does not steeply change even if the piezoelectric members 12 and 13 are brought into the unloaded state.

A brief description will be given of an action of the ink-jet head drive device 30 on the second pattern example with reference to FIGS. 14 to 16.

Before the start of the drop cycle, potential of the drive pulse signals DPi−1, DPi, and DPi+1 is in the NGD level in the same manner as in the first pattern example. However, the load voltage initial value LNINIT is "2" in the second pattern example. Therefore, the third system selecting signal LVSc is output from the load voltage generation circuit 56 to the load voltage selecting circuit 34. In doing so, the VAN voltage is selected as the load voltage LV by the load voltage selecting circuit 34.

If the drive enable signal DE is output from the drop cycle timing control unit 52 and the drive waveform state is brought into the initial state STR0, the drive waveform code for the channel ch.i as the target of ink ejection is "3" as shown in FIG. 14, and therefore, the first system drive control signal DR1a is output from the drive waveform generation circuit 55-*i* to the corresponding drive circuit 33-*i*. In doing so, the first connecting circuit 411 is turned on at the drive circuit 33-*i*. As a result, potential of the drive pulse signal DPi falls to the input voltage to the LVIN terminal, namely to the VAN voltage.

In addition, since the drive waveform high-impedance signal "NEIGHBORHi-Z" is "1" although the drive waveform codes for the channels ch.i−1 and ch.i+1 on both sides thereof are "3", the first system drive control signal DR1a is not output from the drive waveform generation circuits 55-(*i*−1) and 55-(*i*+1) to the corresponding drive circuits 33-(*i*−1) and 33-(*i*+1). Therefore, the first connecting circuit 411 is not turned on at the drive circuits 33-(*i*−1) and 33-(*i*+1). As a result, potential of the drive pulse signals DPi−1 and DPi+1 is affected by DPi due to capacity coupling and falls to the VAN voltage.

Similarly, if the drive enable signal DE is output and the load voltage state is brought into the initial state LVSTR0, the load voltage control code LVCD is "2" as shown in FIG. 15, and therefore the third system selecting signal LVSc is continuously output from the load voltage generation circuit 56. In doing so, the VAN voltage is continuously selected as the load voltage LV by the load voltage selecting circuit 34.

If the time of the drive waveform state timing setting data TIM0 passes and the drive waveform state is brought into the first stage STR1, all the drive waveform code for the channel ch.i and the drive waveform codes for the channels ch.i−1 and ch.i+1 are "2" as shown in FIG. 14, and therefore, the fourth system drive control single DR1d is output from the drive waveform generation circuits 55-(*i*−1), 55-*i*, and 55-(*i*+1) to the corresponding drive circuits 33-(*i*−1), 33-*i*, and 33-(*i*+1). In doing so, the fourth connecting circuit 414 is turned on at all the drive circuits 33-(*i*−1), 33-*i*, and 33-(*i*+1). As a result, potential of the drive pulse signals DPi−1, DPi, and DPi+1 is maintained at the VAN voltage.

Potential of the drive pulse signals DPi−1, DPi, and DPi+1 varies at the control timing shown in FIG. 16 in accordance with the drive waveform codes shown in FIG. 14 even from the second stage STR2 to the thirtieth stage STR30 of the drive waveform state thereafter. Similarly, some of the VAP voltage, the VAN voltage, and the GND level are selected as the load voltage LV by the load voltage selecting circuit 34 at the control timing as shown in FIG. 16 in accordance with the load voltage control code LVCD shown in FIG. 15 even from the first stage LVSTR1 to the fourth stage LVSTR4 of the load voltage state in the same manner.

Here, all the drive pulse signal DPi for the channel ch.i as the target of ink ejection and the drive pulse signals DPi−1 and DPi+1 for the channels ch.i−1 and ch.i+1 on both sides thereof fall from the GND level to the VAN voltage in the initial state STR0 of the drive waveform state as shown in FIG. 16. Therefore, voltage is equally applied to the electrodes 19 at both ends of the piezoelectric members 12 and 13 which form the partition walls of the ink chamber 22 corresponding to the channel ch.i. That is, the piezoelectric members 12 and 13 do not act as the load capacity, and an unloaded state is obtained.

However, the first connecting circuit 411 is turned on at the drive circuit 33-*i* at this time. In addition, the first connecting circuit 411 is turned off at the drive circuits 33-(*i*−1) and 33-(*i*+1). That is, the input voltage to the LVIN terminal is selected as potential of the drive pulse signal DPi. At this time, the VAN voltage as the load voltage initial value is applied to the LVIN terminal. In addition, potential of the drive pulse signals DPi−1 and DPi+1 is affected by DPi due to capacity coupling and changed to the potential of DPi. Therefore, the drive pulse signal DPi for the channel ch.i falls from the GND level to the VAN voltage.

In addition, since the drive pulse signals DPi−1 and DPi+1 for the channels ch.i−1 and ch.i+1 are affected by the drive pulse signal DPi due to the capacity coupling and changed to the potential of the drive pulse signal DPi, the potential of the drive pulse signals DPi−1 and DPi+1 falls from the GND level to the VAN voltage. Here, a high-impedance switching element which has high internal resistance is employed as the first connecting circuit 411. Therefore, since the potential of the drive pulse signal DPi−1, DPi, and DPi+1 gradually falls to the VAN level, voltage applied to the piezoelectric members 12 and 13 does not steeply change even if the piezoelectric members 12 and 13 are brought into the unloaded state.

In addition, all the drive pulse signal DPi for the channel ch.i as the target of ink ejection and the drive pulse signals DPi−1 and DPi+1 for the channels ch.i−1 and ch.i+1 on both sides thereof are raised from the GND level to the VAP voltage in the tenth stage STR10 of the drive waveform state. Therefore, voltage is equally applied to the electrodes 19 at both ends of the piezoelectric members 12 and 13 which form the partition walls of the ink chamber 22 corresponding to the channel ch.i. That is, the piezoelectric members 12 and 13 are still in the unloaded state.

However, the first connecting circuit 411 is turned on at all the drive circuits 33-(*i*−1), 33-*i*, and 33-(*i*+1) even at this time. That is, the input voltage to the LVIN terminal is selected as the potential of the drive pulse signal DPi−1, DPi, and DPi+1. At this time, the potential of the LVIN terminal is a value in the second stage LVSTR2, namely the VAP voltage. Therefore, all the drive pulse signals DPi−1, DPi, and DPi+1 for the respective channels ch.i−1, ch.i, and ch.i+1 are raised from the GND level to the VAP voltage.

However, a high-impedance switching element which has high internal resistance is employed as the first connecting circuit 411 as described above. Therefore, since the potential of the drive pulse signals DPi−1, DPi, and DPi+1 is gradually raised to the VAP voltage, the voltage applied to the electrodes of the piezoelectric members 12 and 13 does not steeply change even if the piezoelectric members 12 and 13 are brought into the unloaded state.

In addition, all the drive pulse signal DPi for the channel ch.i as the target of ink ejection and the drive pulse signals DPi−1 and DPi+1 for the channels ch.i−1 and ch.i+1 on both sides thereof fall from the VAP voltage to the GND level in the twentieth stage STR20 of the drive waveform state. Therefore, voltage is equally applied to the electrodes 19 at both ends of the piezoelectric members 12 and 13 which form the partition walls of the ink chamber 22 corresponding to the channel ch.i. That is, the piezoelectric members 12 and 13 are still in the unloaded state.

However, the first connecting circuit 411 is turned on at all the drive circuits 33-(*i*−1), 33-*i*, and 33-(*i*+1) even at this time. That is, the input voltage to the LVIN terminal is selected as the potential of the drive pulse signals DPi−1, DPi, and DPi+1. At this time, the potential of the LVIN terminal is a value in the third stage LVSTR3, namely the GND level. Therefore, all the drive pulse signals DPi−1, DPi, and DPi+1 for the respective channels ch.i−1, ch.i, and ch.i+1 fall from the VAP voltage to the GND level.

However, a high-impedance switching element which has high internal resistance is employed as the first connecting circuit 411 as described above. Therefore, since the potential of the drive pulse signals DPi−1, DPi, and DPi+1 gradually falls to the GND level, the voltage applied to the electrodes of the piezoelectric members 12 and 13 does not steeply change even if the piezoelectric members 12 and 13 are brought into the unloaded state.

According to the embodiments, it is possible to reduce noise caused by a phenomenon that the piezoelectric members 12 and 13 are brought into the unloaded state without providing, for each of the channel drive circuits 33-1 to 33-N, a detection circuit for detecting that potential applied to electrodes at both ends of the piezoelectric members 12 and 13 simultaneously changes in the same direction out of the positive direction and the negative direction as described above.

Accordingly, it is possible to decrease an IC in size as compared with a case where the detection circuit is required, in an attempt of configuring, as an IC, a drive device with the respective channel drive circuits 33-1 to 33-N integrated thereon. In addition, it is possible to manufacture the IC at low costs.

In addition, although the ink-jet head drive device 30 with three types of drive power sources, namely the VAP power source, the VAN power source, and the GND was exemplified in the embodiments, the exemplary embodiments can be similarly applied to an ink-jet head drive device which operates by two types of drive power sources or an ink-jet head drive device which operates by four or more types of drive power sources.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An ink-jet head drive device comprising:

voltage selecting means for selecting arbitrary voltages among a plurality of kinds of voltages required for generating a drive signal for variably controlling potential to be applied to electrodes which are respectively arranged at a plurality of channels of an ink-jet head;

a plurality of channel drive means for respectively connecting each drive voltage input terminal with an output terminal by a low-impedance connecting circuit which has a low internal resistance and connecting a selected voltage input terminal and the output terminal by a high-impedance connecting circuit which has a high internal resistance, each of the plurality of channel drive means including the output terminal provided corresponding to each channel of the ink-jet head so as to output the drive signal to a corresponding channel, a plurality of drive voltage input terminals, to which the plurality of kinds of voltages is respectively applied, and the selected voltage input terminal, to which the voltage selected by the voltage selecting means is applied; and drive waveform transition control means for controlling a drive waveform transition pattern of the drive signal for each channel drive means such that the drive signal is output via the high-impedance connecting circuit while a potential applied to the respective electrodes simultaneously changes in a same direction out of a positive direction and a negative direction and that the drive signal is output via the low-impedance connecting circuit in the other cases.

2. The device according to any one of claim 1, wherein the voltage selecting means selects voltage out of a ground level as a reference voltage, a positive drive voltage with a potential in a positive direction as compared with the ground level, and a negative drive voltage with a potential which is the same as that of the positive drive voltage in the negative direction as compared with the ground level.

3. The device according to claim 1, further comprising:

voltage transition control means for controlling a transition pattern of voltage to be selected by the voltage selecting means, wherein control timing by the voltage transition control means shares a drop cycle time required for ejecting a one-drop ink droplet from the channel with control timing by the drive waveform transition control means while the voltage transition control means controls state time in the drop cycle based on an independent time axis.

4. The device according to any one of claim 3, wherein the voltage selecting means selects voltage out of a ground level as a reference voltage, a positive drive voltage with a potential in a positive direction as compared with the ground level, and a negative drive voltage with a potential which is the same as that of the positive drive voltage in the negative direction as compared with the ground level.

5. The device according to claim 3, wherein the voltage transition control means includes an initial voltage setting means for setting a voltage to be selected by the voltage selecting means before start of the drop cycle.

6. The device according to any one of claim 5, wherein the voltage selecting means selects voltage out of a ground level as a reference voltage, a positive drive voltage with a potential in a positive direction as compared with the ground level, and a negative drive voltage with a potential which is the same as that of the positive drive voltage in the negative direction as compared with the ground level.

* * * * *